US012263388B2

(12) United States Patent
Phelan, Jr. et al.

(10) Patent No.: US 12,263,388 B2
(45) Date of Patent: Apr. 1, 2025

(54) SPORTS IMPLEMENT HAVING ASYMMETRIC GRIP

(71) Applicant: PROXR, LLC, Kirkwood, MO (US)

(72) Inventors: Gerald Leo Phelan, Jr., St. Louis, MO (US); Ronald Saslow, Highland Park, IL (US); Joseph Saslow, Highland Park, IL (US)

(73) Assignee: PROXR, LLC, Kirkwood, MO (US)

( * ) Notice: Subject to any disclaimer, the term of this patent is extended or adjusted under 35 U.S.C. 154(b) by 579 days.

(21) Appl. No.: 17/509,477

(22) Filed: Oct. 25, 2021

(65) Prior Publication Data

US 2022/0126180 A1 Apr. 28, 2022

Related U.S. Application Data

(60) Provisional application No. 63/105,594, filed on Oct. 26, 2020.

(51) Int. Cl.

| | |
|---|---|
| ***A63B 60/12*** | (2015.01) |
| ***A63B 102/02*** | (2015.01) |
| ***A63B 102/08*** | (2015.01) |
| ***A63B 102/16*** | (2015.01) |

(52) U.S. Cl.

CPC ..... *A63B 60/12* (2015.10); *A63B 2102/02* (2015.10); *A63B 2102/08* (2015.10); *A63B 2102/16* (2015.10)

(58) Field of Classification Search

CPC ..... A63B 60/06; A63B 60/10; A63B 60/12; A63B 60/34

USPC ..... 473/526, 527, 538, 549, 551, 568

See application file for complete search history.

(56) References Cited

U.S. PATENT DOCUMENTS

| | | | | | |
|---|---|---|---|---|---|
| 1,828,109 | A | * | 10/1931 | Fox | A63B 49/08 473/549 |
| 3,545,755 | A | * | 12/1970 | Owada | A63B 49/00 473/526 |
| 3,554,545 | A | * | 1/1971 | Mann | A63B 59/58 473/564 |
| 3,905,598 | A | | 9/1975 | Ballog | |
| 4,147,348 | A | * | 4/1979 | Lee | A63B 60/34 473/526 |
| 4,351,529 | A | | 9/1982 | Schultz et al. | |

(Continued)

OTHER PUBLICATIONS

International Application No. PCT/US2021/056427, International Search Report and Written Opinion, mailed Jan. 21, 2022.

(Continued)

*Primary Examiner* — Joseph B Baldori

(74) *Attorney, Agent, or Firm* — MARSHALL, GERSTEIN & BORUN LLP

(57) ABSTRACT

A sports implement includes a main body portion, a handle portion extending from the main body portion, and a grip member. The main body portion includes a first contact surface, a second contact surface, and a sidewall positioned about a perimeter of each of the first and the second contact surfaces. The handle portion defines a handle central axis extending therethrough. The grip member includes a grip body portion and a grip end portion. The grip body portion is operably coupled with the handle portion. The grip end portion defines a grip central axis extending therethrough. The handle central axis is offset from and parallel to the grip central axis.

18 Claims, 26 Drawing Sheets

(56) References Cited

U.S. PATENT DOCUMENTS

| | | | | | |
|---|---|---|---|---|---|
| 4,360,201 | A * | 11/1982 | Biehl | A63B 49/08 | 473/526 |
| 4,470,599 | A * | 9/1984 | Usher, Jr. | A63B 60/08 | 473/551 |
| 4,659,080 | A * | 4/1987 | Stoller | A63B 60/34 | 473/526 |
| 4,743,021 | A * | 5/1988 | Gonzales, Jr. | A63B 60/34 | 473/526 |
| 4,759,546 | A * | 7/1988 | Steele, Jr. | A63B 60/10 | 473/526 |
| 4,934,024 | A * | 6/1990 | Sexton, I | B25G 1/102 | 264/222 |
| 5,657,985 | A * | 8/1997 | Dahlstrom | A63B 60/08 | 473/551 |
| 6,083,125 | A * | 7/2000 | West | A63B 60/22 | 473/549 |
| 7,878,930 | B2 * | 2/2011 | Leinert | A63B 60/12 | 473/568 |
| 8,210,969 | B2 * | 7/2012 | Clancy | A63B 49/08 | 473/549 |
| 8,708,846 | B2 * | 4/2014 | Hisle, Jr. | A63B 60/08 | 473/568 |
| 8,845,462 | B2 * | 9/2014 | Chung | A63B 59/50 | 422/422 |
| D761,925 | S * | 7/2016 | Phelan, Jr. | D21/753 | |
| D823,409 | S | 7/2018 | Williams | | |
| D846,674 | S | 4/2019 | Yan | | |
| D847,283 | S | 4/2019 | Yan | | |
| 10,377,093 | B2 | 8/2019 | Filippini | | |
| 10,898,772 | B2 * | 1/2021 | Phelan, Jr. | A63B 60/14 | |
| 11,253,761 | B2 * | 2/2022 | Phelan, Jr. | A63B 59/20 | |
| 11,602,680 | B1 * | 3/2023 | Ellington | A63B 59/58 | |
| 2004/0147346 | A1 | 7/2004 | Casasanta, Jr. | | |
| 2010/0004077 | A1 * | 1/2010 | Shimamoto | A63B 60/06 | 473/564 |
| 2017/0165548 | A1 * | 6/2017 | Phelan, Jr. | A63B 60/12 | |
| 2017/0182387 | A1 * | 6/2017 | Phelan, Jr. | A63B 59/20 | |
| 2018/0104555 | A1 | 4/2018 | Taylor | | |
| 2018/0304132 | A1 * | 10/2018 | Epp | A63B 60/14 | |
| 2019/0046851 | A1 * | 2/2019 | Phelan, Jr. | A63B 59/70 | |
| 2021/0283469 | A1 * | 9/2021 | Nelson | A63B 60/16 | |
| 2022/0088449 | A1 * | 3/2022 | Marshall | A63B 59/42 | |
| 2023/0181980 | A1 * | 6/2023 | Angelelli | A63B 60/16 | 473/551 |
| 2023/0191215 | A1 * | 6/2023 | Barnes | A63B 59/42 | 473/527 |

OTHER PUBLICATIONS

European Patent Application No. 21887252.1, Extended European Search Report, mailed Aug. 26, 2024.

* cited by examiner

SPORTS IMPLEMENT HAVING ASYMMETRIC GRIP

CROSS REFERENCE TO RELATED APPLICATIONS

This application claims the benefit of U.S. Provisional Application No. 63/105,594, filed on Oct. 26, 2020, the entirety of which is expressly incorporated by reference herein.

FIELD OF THE DISCLOSURE

The present disclosure generally relates to sports implements and, more particularly, to paddles and/or rackets having asymmetric grip arrangements.

BACKGROUND

Swinging implements include a handle that are grasped in the hand(s) and swung with a greater and/or exaggerated arm motion. Swinging implements may take the form of paddles and/or rackets used to strike balls and/or objects of varying shapes and sizes. For example, paddles or rackets are used to strike balls in the sports of pickleball, tennis, platform tennis and the like.

Generally, the paddles and/or rackets include a contact portion that strikes the object and a handle portion that a user grasps to maneuver the implement. In some examples, the swinging implements may include an oval shaped handle. This oval shape, when gripped, advantageously maintains the user's hands (i.e., the carpal, metacarpal and phalanx bones) and wrists in alignment with the path of the swing, thus resulting in a more accurate delivery of the implement to the targeted object of contact. However, users may desire implements capable of providing increased power and/or accuracy. Further, prolonged use these implements may cause user discomfort.

As described in more detail below, the present disclosure sets forth paddles and/or rackets having asymmetric grips embodying advantageous alternatives to existing systems and methods, and that may address one or more of the challenges or needs mentioned herein, as well as provide other benefits and advantages.

SUMMARY

Embodiments within the scope of the present disclosure are directed to a sports implement including a main body portion, a handle portion extending from the main body portion, and a grip member. The main body portion includes a first contact surface, a second contact surface, and a sidewall positioned about a perimeter of each of the first and the second contact surfaces. The handle portion defines a handle central axis extending therethrough. The grip member includes a grip body portion and a grip end portion. The grip body portion is operably coupled with the handle portion. The grip end portion defines a grip central axis extending therethrough. The handle central axis is offset from and parallel to the grip central axis.

In some examples, the first contact surface may include a left side of the main body portion and the second contact surface may include a right side of the main body portion. Each of the first and the second contact surfaces may be generally planar.

In some approaches, the sports implement may include a plane extending through the sidewall upon which each of the handle central axis and the grip central axis are disposed. Further, in some examples, the sports implement may include a transition region between the grip body portion and the grip end portion. The transition region may have a first side defining a dorsal cantle region and a second side defining a ventral cantle region. At least one of the dorsal cantle region and the ventral cantle region may bisect or divide the plane. In some examples, at least one of the dorsal cantle region or the ventral cantle region may be canted relative to the plane. Further, in some examples, the plane may be parallel to at least one of the first or the second contact surfaces.

In some forms, the main body portion, the handle portion, and the grip member have a combined length of less than 18". In some examples, the grip member has an overall length dimensioned to accommodate a single hand. In some of these examples, the grip body portion may include at least one finger positioning member extending therealong.

In some examples, the main body portion may define a main body length, and the handle portion and grip member may define a grip length. The main body length and the grip length may combine to define an overall length. A ratio of the grip length to the main body length may be between approximately 1:3 and approximately 3:5. Further, in some examples, a ratio of the grip length to the overall length may be between approximately 1:4 and approximately 2:5.

In accordance with a second aspect, a sports implement is provided that includes a main body portion, a handle portion, and a grip member. The main body portion includes a first contact surface, a second contact surface a sidewall extending between the first and the second contact surfaces, an upper end, a lower end, a first side, and a second side. The handle portion extends from the lower end of the main body portion and defines a handle central axis extending therethrough. The grip member includes a grip body portion that is operably coupled with the handle portion, a grip end portion, and a transition region having a first side and a second side extending between the grip body portion and the grip end portion. The first side of the transition region faces the first side of the main body portion and defines a dorsal cantle region and the second side faces the second side of the main body portion and defines a ventral cantle region.

In accordance with a third aspect, a sports implement is provided that includes a main body portion, a handle portion extending from the main body portion, and a grip member. The main body portion has a first contact surface, a second contact surface, and a sidewall positioned about a perimeter of each of the first and the second contact surfaces. The sidewall is bisected by a sagittal plane. The handle portion extends from the main body portion and defines a handle central axis extending therethrough. The grip member includes a grip body portion operably coupled with the handle portion, a grip end portion, and a transition region having a first side and a second side extending between the grip body portion and the grip end portion. The first side of the transition region defines a dorsal cantle region and the second side defines a ventral cantle region. At least one of the dorsal cantle region or the ventral cantle region is positioned asymmetrically relative to the sagittal plane.

In accordance with a fourth aspect, a sports implement is provided that includes a main body portion, a handle portion extending from the main body portion at an extension location defining a plane, and a grip member. The main body portion includes a first contact surface, a second contact surface, and a sidewall positioned about a perimeter of each of the first and the second contact surfaces. The handle portion defines a handle central axis extending therethrough.

The grip member includes a grip body portion and a grip end portion. The grip body portion is operably coupled with the handle portion, and the grip end portion defines a first apex positioned on a first side of the grip end portion and a second apex positioned on a second side of the grip end portion. The first apex is a first distance from the plane defined by the extension location and the second apex is a second distance from the plane defined by the extension location. The first distance is less than the second distance.

In accordance with a fifth aspect, a sports implement is provided that includes a main body portion, a handle portion extending from the main body portion, and a grip member. The main body portion has a first contact surface, a second contact surface, and a sidewall positioned about a perimeter of each of the first and the second contact surfaces. The handle portion defines a handle central axis extending therethrough. The grip member includes a grip body portion and a grip end portion. The grip body portion is operably coupled with the handle portion, and the grip end portion defines a first apex positioned on a first side and a second apex positioned on a second side that combine to form a grip end plane. The grip end plane forms an obtuse angle with the handle central axis.

In accordance with a sixth aspect, a grip member for a pickleball paddle is provided that includes a grip body portion and a grip end portion operably coupled with the grip body portion. The grip body portion defines a cavity and a grip body longitudinal axis extending therethrough. The grip end portion defines a grip central axis. The grip central axis is offset from and parallel to the grip body longitudinal axis.

In accordance with a seventh aspect, a grip member for a pickleball paddle is provided that includes a grip body portion defining a cavity and being bisected by a sagittal plane, a grip end portion operably coupled with the grip body portion, and a transition region. The transition region has a first side and a second side extending between the grip body portion and the grip portion. The first side of the transition region defines a dorsal cantle region and the second side of the transition region defines a ventral cantle region. At least one of the dorsal cantle region or the ventral cantle region is positioned asymmetrically relative to the sagittal plane.

BRIEF DESCRIPTION OF THE DRAWINGS

The above needs are at least partially met through provision of the sports implement described in the following detailed description, particularly when studied in conjunction with the drawings, wherein.

Figure 1A:
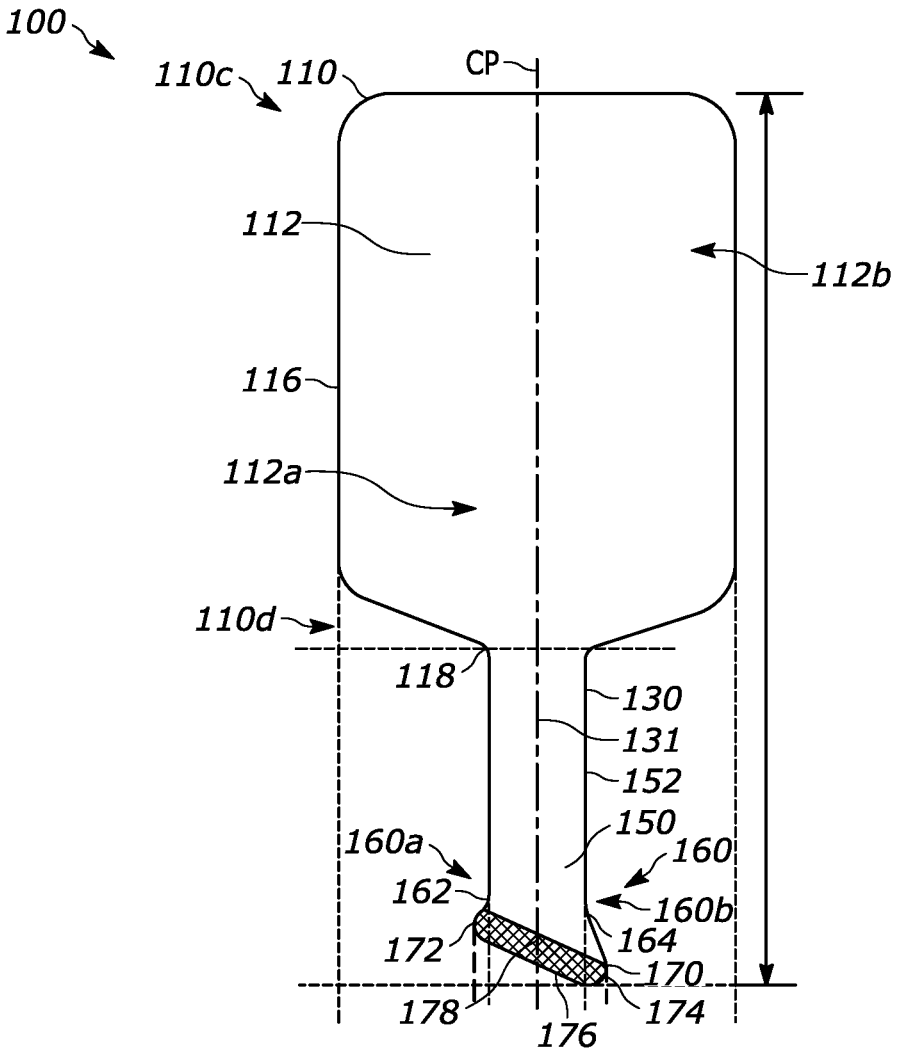
FIG. 1*a* illustrates a front elevation view of a first example sports implement in accordance with various embodiments.

Skilled artisans will appreciate that elements in the figures are illustrated for simplicity and clarity and have not necessarily been drawn to scale. For example, the dimensions and/or relative positioning of some of the elements in the figures may be exaggerated and/or simplified relative to other elements to help to improve understanding of various embodiments of the present disclosure. Also, common but well-understood elements that are useful or necessary in a commercially feasible embodiment are often not depicted in order to facilitate a less obstructed view of these various embodiments. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

The following definitions and methods are provided to better define the present disclosure and to guide those of ordinary skill in the art in the practice of the present disclosure. Unless otherwise noted, terms are to be understood according to conventional usage by those of ordinary skill in the relevant art.

The term "axially symmetric" as used herein refers to symmetry about an axis in a direction that is perpendicular to the axis.

The term "cantle" as used herein in connection with a surface refers to a surface that is curved upwardly. In the context of the present disclosure, the ventral cantle is adapted to engage the hypothenar of a gripping hand of a user, and the dorsal cantle engages the pinky of the gripping hand. Like a cantle of a saddle, which cradles the gluteus maximus or bottom of a rider, the cantle-like structure of the knob described herein cradles the hypothenar of the hand in the same way giving support, stability and increased surface area contact to the hand throughout a swing.

The term "coronal plane" as used herein refers to an imaginary plane containing the central longitudinal axis dividing a knob of the present disclosure (or an element thereof) into ventral and dorsal (anterior and posterior, respectively) sections. The coronal plane is orthogonal to the sagittal plane, and the two planes intersect along the central longitudinal axis.

The term "sagittal plane" as used herein refers to an imaginary vertical, longitudinal plane containing the central longitudinal axis which passes from anterior to posterior along the central longitudinal axis, dividing a knob of the present disclosure (or an element thereof) into right and left halves. The sagittal plane is orthogonal to the coronal plane, and the two planes intersect along the central longitudinal axis.

The term "supplementary angles" as used herein refers to two angles having a sum of 180 degrees.

When introducing elements of the present disclosure or the embodiments(s) thereof, the articles "a", "an", "the" and "said" are intended to mean that there are one or more of the elements. The terms "comprising", "including" and "having" are intended to be inclusive and not exclusive (i.e., there may be other elements in addition to the recited elements). The use of "or" means "and/or" unless specifically stated otherwise, and the use of the singular includes the plural and plural encompasses singular, unless specifically stated otherwise.

Generally speaking, pursuant to these various embodiments, a sports implement is provided in the form of a pickleball paddle (or other similar implement such as, for example a table tennis racket or paddle, a platform tennis racket or paddle, a tennis racket, and the like) that includes an ergonomic grip member that is asymmetrically arranged to improve user comfort, stability, increase striking power, and reduce fatigue. The grip member may be provided in a number of arrangements to accommodate left-handed users, right-handed users, or alternatively, both left-handed and right-handed users. The grip member may be configured for single-hand use—that is, the grip member may have a length dimension that only accommodates a width of a single hand of a user. In some examples, the grip member may be provided as an accessory that couples with a handle portion of the sports implement in a manner that allows the grip member to be replaceable as desired.

Turning to the figures, and more specifically to FIGS. 1*a*-1*f*, a first embodiment of a sports implement 100 is provided in the form of a pickleball paddle. The paddle 100 includes a main body portion 110, a handle portion 130 extending from the main body portion 110, and a grip member 150. The main body portion 110 has a first or left side 110*a* that includes a first contact surface 112, a second or right side 110*b* that includes a second contact surface 114, an upper end 110*c*, a lower end 110*d* and a sidewall 116 positioned about a perimeter of each of the first and second contact surfaces 112, 114. The sidewall 116 may be bisected by a plane (e.g., the sagittal plane "SP" illustrated in FIG. 1*b*). Further, the first and second contact surfaces 112, 114 may be bisected by a plane (e.g., the coronal plane "CP") such that each of the first and second contact surfaces 112, 114 include first and second segments (or sides) 112*a*, 112*b*.

In some examples, the first and/or the second contact surfaces 112, 114 may be generally planar or have a slight curvature. In examples where the first and/or the second contact surfaces 112, 114 are generally planar, these surfaces may be parallel to the sagittal plane.

Generally, the main body portion 110 of the paddle 100 is constructed by disposing a honeycombed or other-shaped, composite and/or diffused material core between laminated layers of a polymeric or other sheet product that defines the first and second contact surfaces 112, 114. An outer bezel may then be applied that defines the sidewall 116. Other examples of suitable construction approaches are possible.

The handle portion 130 is operably coupled with the lower end 110*d* of the main body portion 110 at an extension location 118. As illustrated in FIG. 1*a*, the extension location 118 may form a reduced width portion relative to the main body portion. The handle portion 130 may define a handle central axis 131 extending therethrough. More specifically, the sagittal and coronal planes may be perpendicular to each other and intersect at the handle central axis 131. In other words, the handle portion 130 may be bisected by the sagittal and coronal planes (and may intersect orthogonally along the central axis 131). Further, the extension location 118 may form a plane that is parallel to the coronal plane. In some examples, the handle portion 130 may be formed integrally with the main body portion 110, and in other examples, the handle portion 130 may be coupled with the main body portion 110 via any number of suitable approaches. With reference to FIG. 1*e*, the handle portion 130 may have a generally ellipsoid or oblong cross sectional configuration. Other examples are possible.

The grip member 150 includes a grip body portion 152, a transition region 160, and a grip end portion 170. The grip body portion 152 includes a length and is operably coupled with the handle portion 130. In some examples, the grip body portion 152 and the handle portion 130 may be integrally formed, and in other examples, the grip body portion 152 and the handle portion 130 may be permanently and/or removably coupled via adhesives, fasteners, and the like. Other examples are possible.

The grip member 150 may be formed from any of a variety of materials that provide desired mechanical strength and tactile properties. In some examples, the grip member 150 may be constructed from a combination of ceramic, metal, polymer, composite, wood or a composite or laminate thereof. More specifically, in some embodiments, the grip member 150 may be at least partially constructed form a polymer such as an epoxy resin, polyamine, polyamide, polycarbonate, polyester, polyether, polyimide, polyurethane, polyvinyl chloride, laser-fused plastic powders, or a copolymer or blend thereof. By way of further example, in some embodiments, the grip member 150 may be constructed from a composite such as a fiber-reinforced polymer wherein the polymer is one of the aforementioned polymers or a co-polymer or blend thereof, and the reinforcing fiber comprises aluminum fibers, an aramid or other polymeric fibers, carbon fibers, ceramic fibers, carbon nanotubes, glass fibers or a combination thereof. Additionally, the grip body portion 152, the transition region 160, and/or the grip end portion 170 may be solid, or wholly or partly hollow.

In some examples, the main body portion 110 may define a main body length. Further, the handle portion 130 and the grip member 150 may cooperate to define a grip length that extends from the extension location 118 to an end of the grip end portion 170. In such examples, the paddle 100 may have an overall combined length between the main body length and the grip length of not more than 18". In other examples, the paddle 100 may have an overall combined length between the main body length and the grip length of not more than 17". In some implementations (and in specific sports with dimensional requirements), width plus length dimensions cannot exceed 24" (specific to pickleball). In other implementations, the overall length of the sports implement may be limited to 29" (e.g., tennis rackets). In some examples, the overall length of the sports implement may be limited to 27" (e.g., squash rackets). Other examples are possible. Accordingly, in any of these examples, the overall grip length may be variable in relation to the dimensions of the main body portion 110. In these and other examples, the grip length may be dimensioned such that the grip body portion 152 (and optionally a portion of the handle portion 130) may be between approximately 3.5" and approximately 6.0". In some examples, a ratio may be defined between the grip lengths to the main body length. This ratio of the grip length to the main body length may be between approximately 1:3 and approximately 3:5. In these and other examples, a ratio may be defined between the grip lengths to the overall length. This ratio may be between approximately 1:4 and 2:5.

Figure 6A:
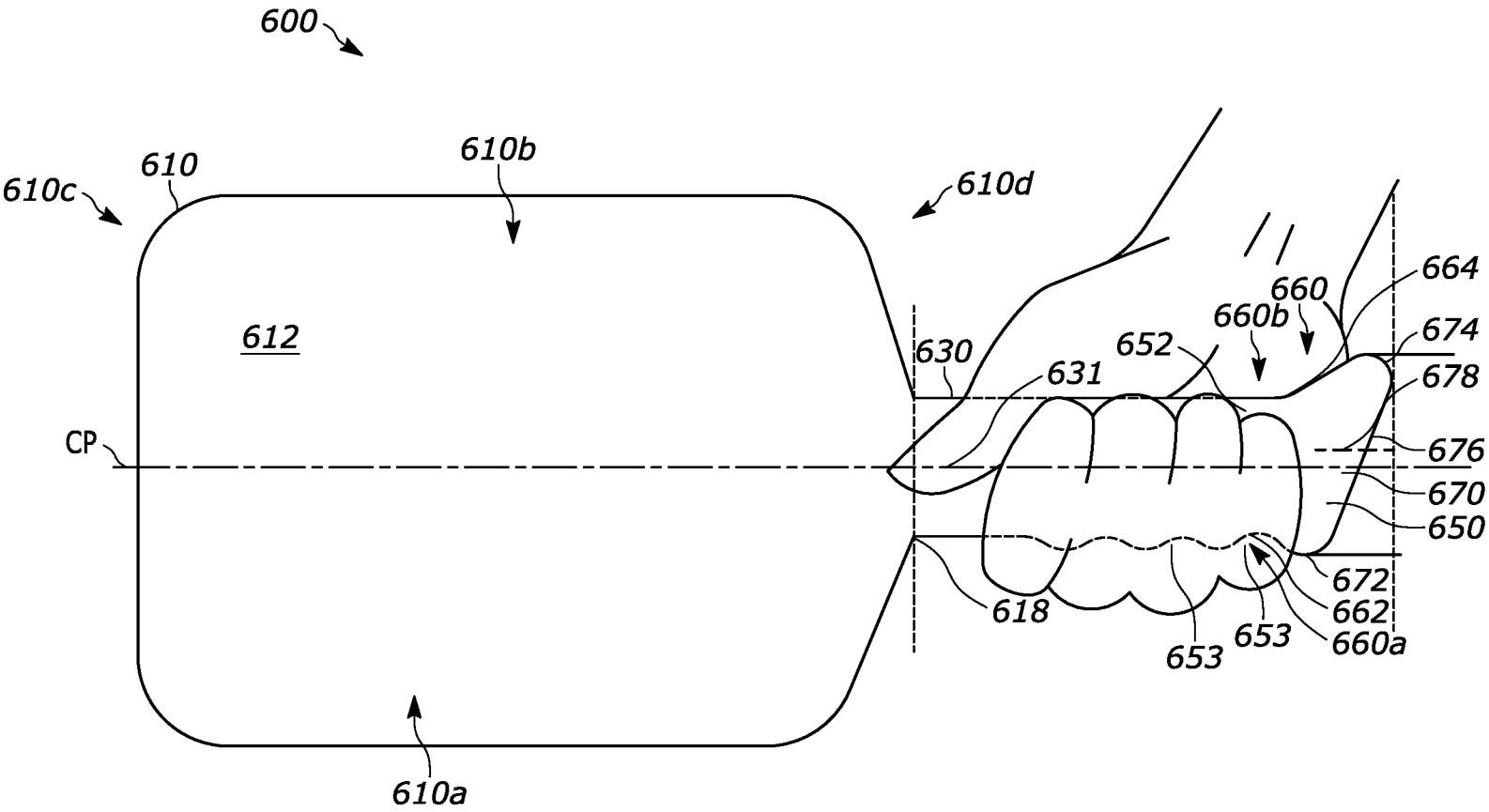
FIG. 6*a* illustrates a front elevation view of a sixth example sports implement having an example finger positioning member in accordance with various embodiments.

Returning to the grip member 150, a user may grasp the grip body portion 152 and the transition region 160 while supporting an athlete's gripping hand (FIG. 6*a*). With reference to FIG. 1*c*, the grip member 150 is divided into two parts by the sagittal plane (which passes through the sidewall 116 of the main body portion 110 and the handle portion 130). In one example, the grip member 150 is bisected by the sagittal plane such that a first side 150*a* (corresponding to the first side 110*a*) of the grip member 150 and a second side 150*b* (corresponding to the second side 110*b*) are mirror images of each other.

Figure 6B:
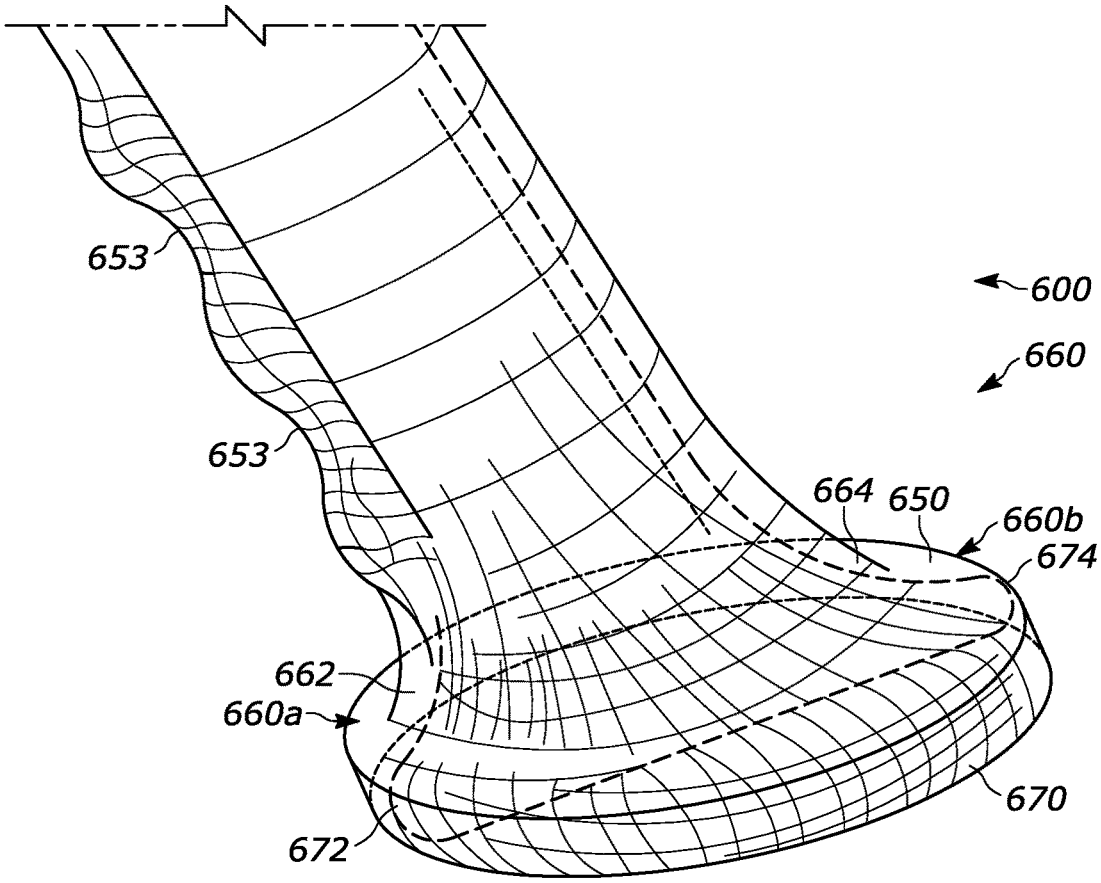
FIG. 6*b* illustrates a perspective view of a portion of the example sports implement of FIG. 6*a* in accordance with various embodiments.
Figure 6C:
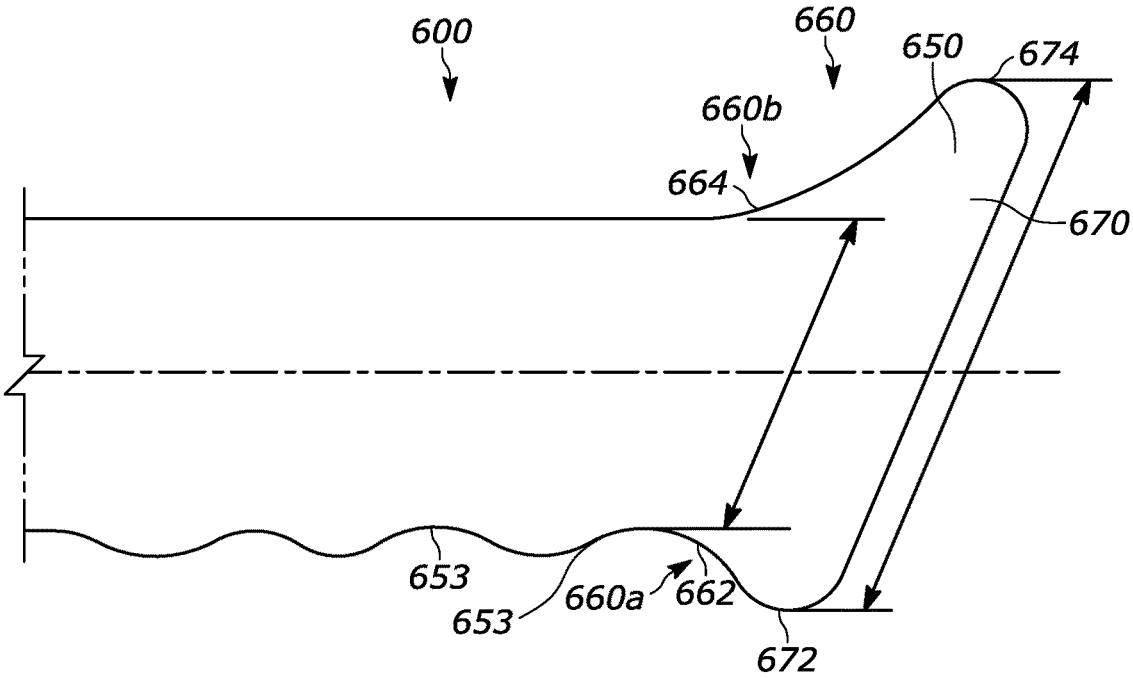
FIG. 6*c* illustrates a front elevation view of a portion of the example sports implement of FIGS. 6*a* and 6*b* in accordance with various embodiments.

The grip body portion 152 provides a gripping surface for a user's palm, thumb, and fingers. In some examples, the grip body portion 152 may have a substantially constant cross-sectional shape extending along the elongated length thereof. However, in other examples, and as illustrated in FIGS. 6*a*-6*c*, the grip body portion 652 may include any number of finger positioning members 653 extending therealong to assist with gripping the paddle 100.

Generally speaking, the transition region 160 defines a transition (i.e., an increase) in overall cross-sectional dimension and geometry of the grip member 150. As illustrated in FIGS. 1*a*, 1*c*, and 1*d*, the transition region 160 includes a first side 160*a* including a curved dorsal cantle region 162 and a second side 160*b* including a curved ventral cantle region 164. More specifically, the coronal plane divides the grip member (i.e., the transition region 160) to define first and second sides 160*a*, 160*b* (FIG. 1*d*), and as illustrated in FIG. 1*f*, the sagittal plane divides the ventral cantle region 164 and the dorsal cantle region (not illustrated) into first and second halves 164*a*, 164*b*, with a first half facing the first side 110*a* of the main body portion 110, and a second half facing the second side 110*b* of the main body portion 110. In some examples, and as illustrated in FIG. 1*f*, the sagittal plane bisects the ventral cantle region 164 and dorsal cantle region 162. However, in other examples, and as will be discussed in further detail below, the sagittal plane may divide the dorsal cantle region 162 and ventral cantle region 164 in an asymmetric manner.

The transition region 160 extends to the grip end portion 170 which defines a first apex 172 positioned adjacent to the dorsal cantle region 162 and a second apex 174 positioned adjacent to the ventral cantle region 164. The first and second apexes 172, 174 generally define a widest overall dimension of the grip end 170 and thus the grip member 150. In some examples, and as illustrated in FIGS. 1*a* and 1*d*, the first and second apexes 172, 174 may then transition to a decreasing curve that ends to define a generally planar end surface 176 defining the end of the grip member 150. However, in other examples (not illustrated), the first and second apexes may define the end of the grip end such that the first and second apexes are positioned along the planar end surface. The generally planar end surface 176 is arranged obtusely (i.e., non-perpendicularly) relative to the handle central axis 131. In other words, a distance from the plane formed at the extension location 118 of the main body portion 110 to the first apex 172 is less than a distance from the plane formed at the extension location 118 of the main body portion 110 to the second apex 174. As such, the ventral cantle region 164 defines a curve having a larger radius of curvature than a radius of curvature of a curve defined by the dorsal cantle region 162.

In some examples, the overall length of the planar end surface 176 extending between the first and second apexes 172, 174 may be longer than a length of a planar surface extending between a conventional grip member having a non-angled grip end (not illustrated). In some examples, the overall lengths may be between approximately 1" and 3.5", as desired. In some examples, the length may only extend outwardly in the ventral cantle region area and not in the dorsal cantle region. Increasing this length provides a user with increased potential support and gripping engagement. Further, an enlarged area of engagement provides increased comfort, improved connection with the paddle, and improved performance.

Figure 1B:
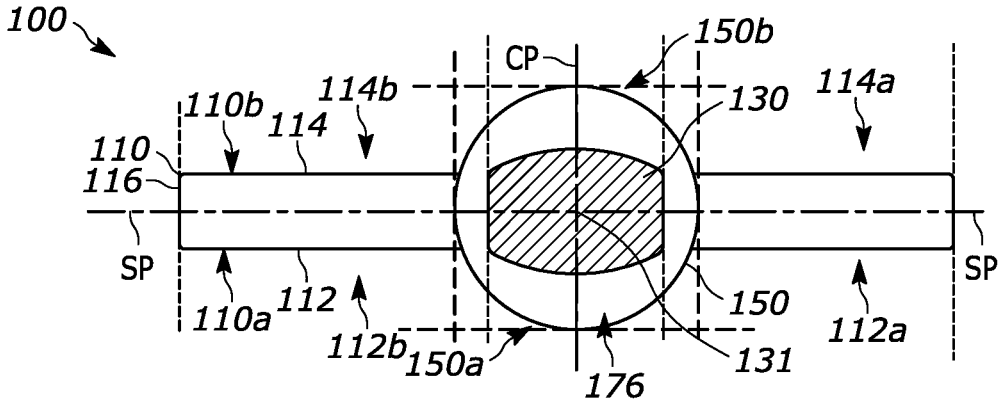
FIG. 1*b* illustrates a rear plan view of the example sports implement of FIG. 1*a* in accordance with various embodiments.
Figure 1C:
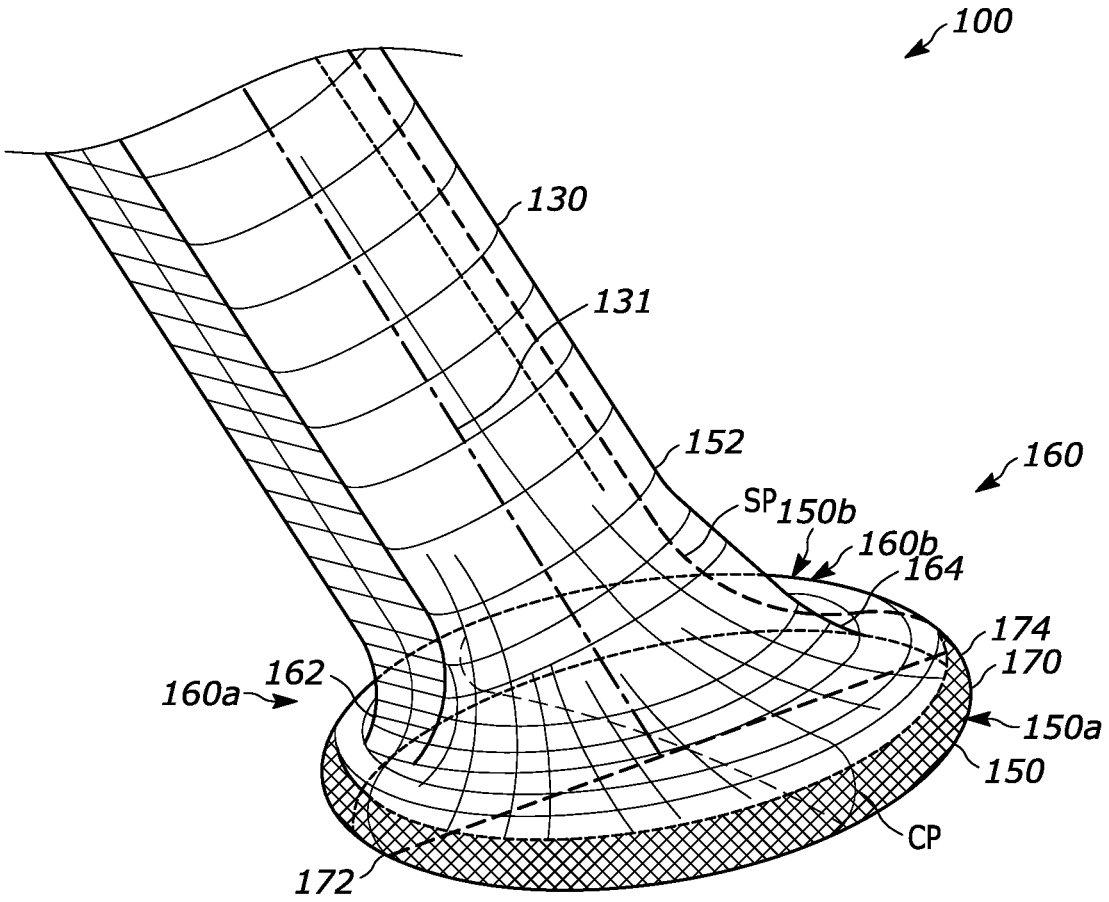
FIG. 1*c* illustrates a perspective view of a portion of the example sports implement of FIGS. 1*a* and 1*b* in accordance with various embodiments.
Figure 1D:
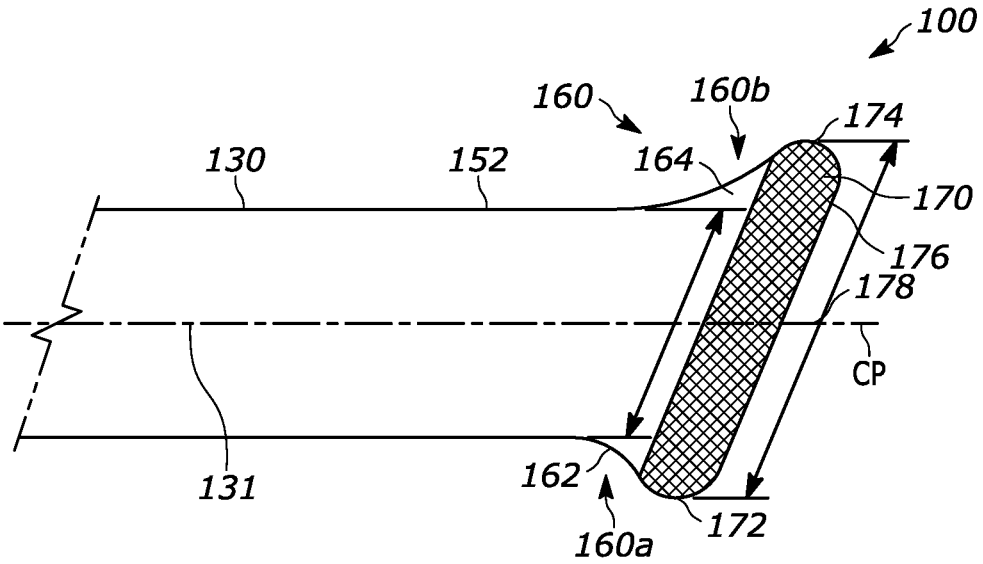
FIG. 1*d* illustrates a front elevation view of a portion of the example sports implement of FIGS. 1*a*-1*c* in accordance with various embodiments.
Figure 1E:
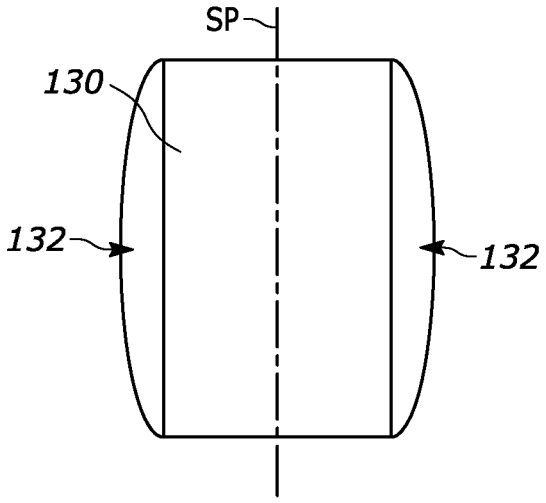
FIG. 1*e* illustrates a cross-sectional view of a handle portion of the example sports implement of FIGS. 1*a*-1*d* in accordance with various embodiments.
Figure 1F:
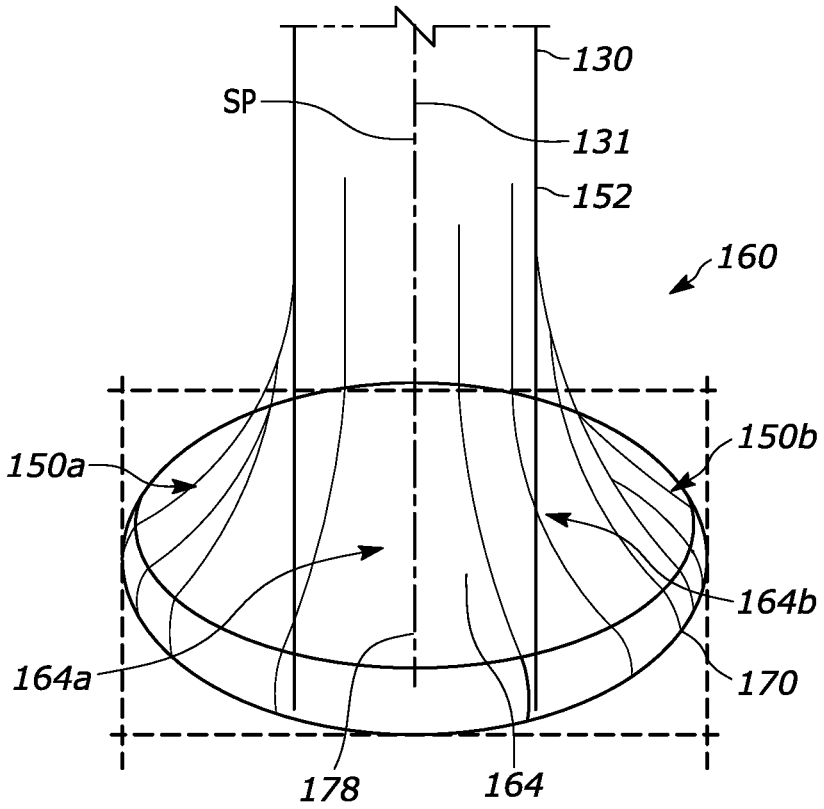
FIG. 1*f* illustrates a right side elevation view of a portion of the example sports implement of FIGS. 1*a*-1*e* in accordance with various embodiments.
Figure 2A:
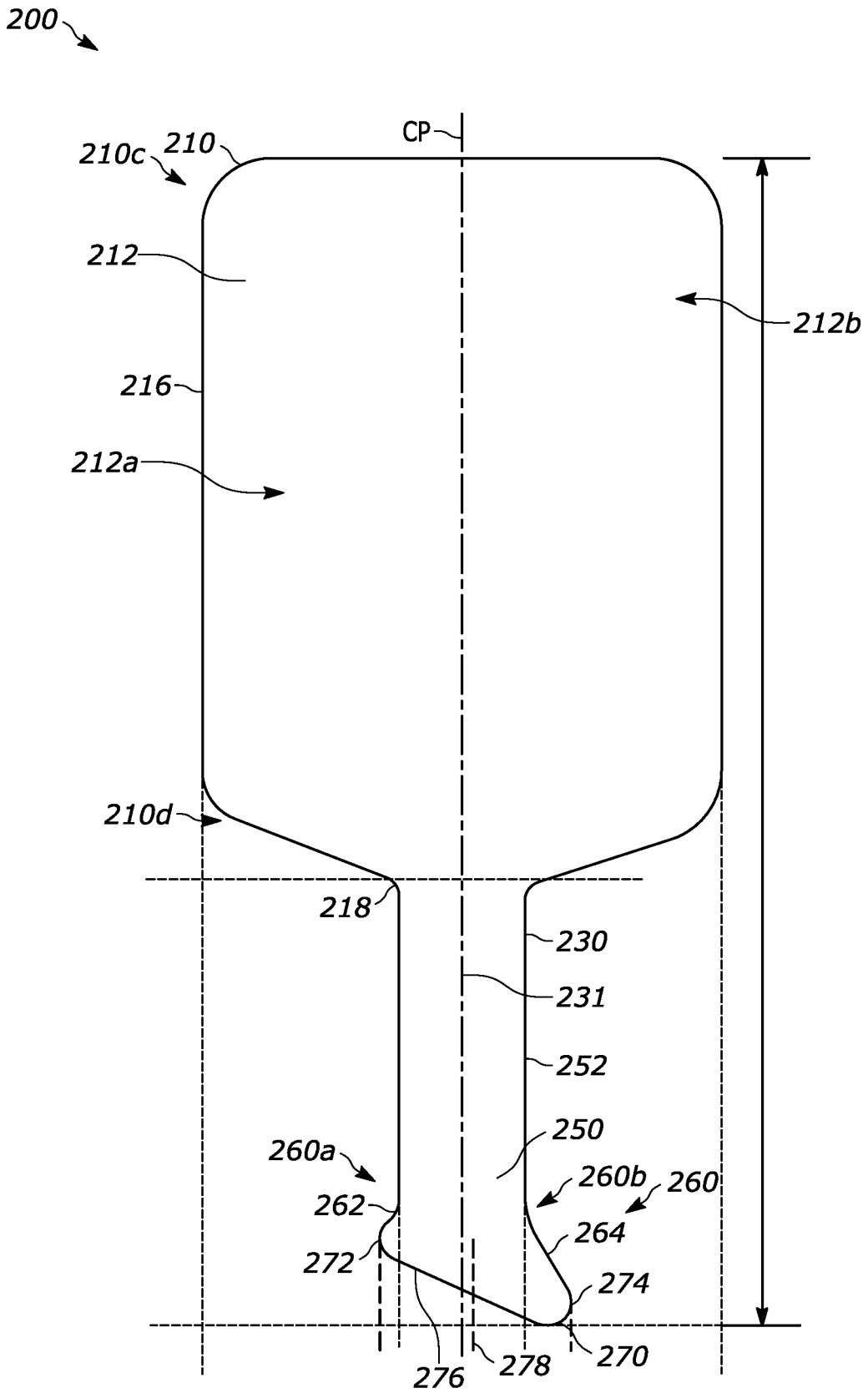
FIG. 2*a* illustrates a front elevation view of a second example sports implement in accordance with various embodiments.
Figure 2B:
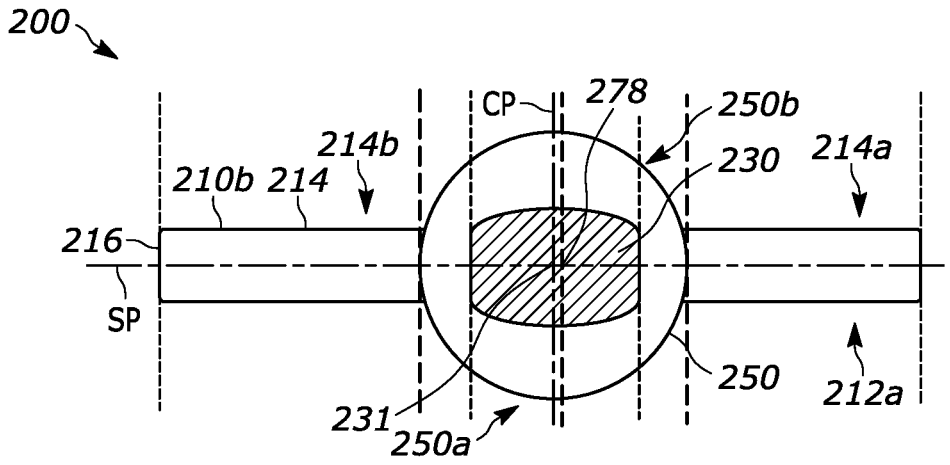
FIG. 2*b* illustrates a rear plan view of the example sports implement of FIG. 2*a* in accordance with various embodiments.
Figure 2C:
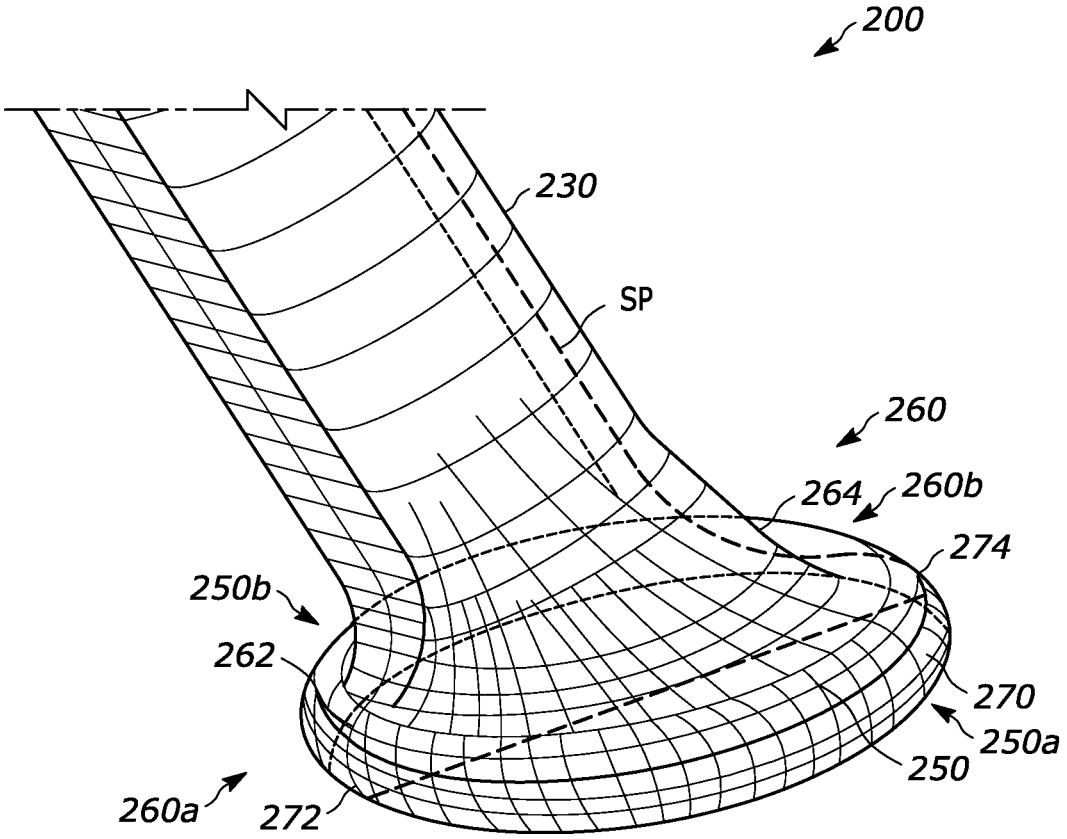
FIG. 2*c* illustrates a perspective view of a portion of the example sports implement of FIGS. 2*a* and 2*b* in accordance with various embodiments.
Figure 2D:
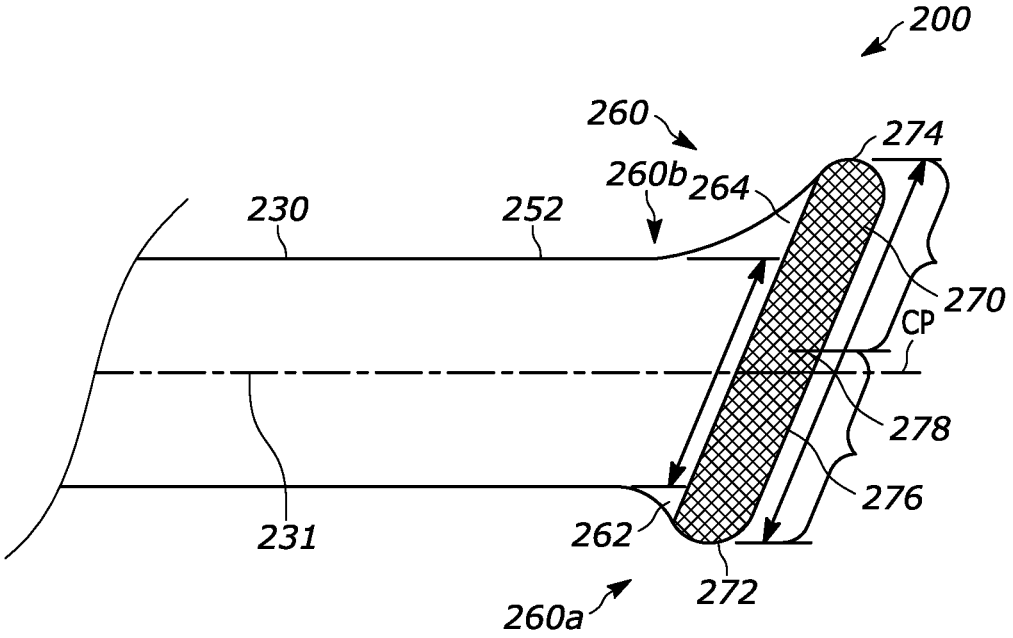
FIG. 2*d* illustrates a front elevation view of a portion of the example sports implement of FIGS. 2*a*-2*c* in accordance with various embodiments.

As illustrated in FIG. 1*b*, in some examples, the planar end surface 176 of the grip end portion 170 may have a generally circular configuration and may define a grip central axis 178 that extends through the grip member 150. In the example paddle 100, the grip central axis 178 is collinear with the handle central axis 131. Further, in the example paddle 100, a distance along the planar end surface 176 from the coronal plane (and the handle central axis 131 and the grip central axis 178) to each of the first and second apexes 172, 174 are equidistant.

As illustrated in FIG. 1*e*, the handle portion 130 may include any number of shims 132 operably coupled therewith to form a desired exterior shape of the handle portion 130. The shims 132 may be in the form of a lightweight member that allows the user to grip the handle portion 130 more comfortably. In some of these examples, the shims 132 may be constructed from a polymeric material, and in other examples, other suitable materials such as wood, metals, and the like may be used.

The paddle 100 described herein may be constructed using any number of suitable alternative approaches. For example, FIGS. 2*a*-2*d* illustrate a second example paddle 200. It is appreciated that the paddle 200 illustrated in FIGS. 2*a*-2*d* may include similar features to the paddle 100 illustrated in FIGS. 1*a*-1*f*, and accordingly, elements illustrated in FIGS. 2*a*-2*d* are designated by similar reference numbers indicated in the embodiment illustrated in FIGS. 1*a*-1*f* increased by 100. Accordingly, these features will not be described in substantial detail. Further, it is appreciated that any of the elements described with regards to the paddle 100 may be incorporated into the paddle 200.

In this example, the grip portion 270 is non-centered relative to the handle portion 230. More specifically, in this example, the grip central axis 278 is offset from and parallel to the handle central axis 231. Accordingly, in this example, a distance (taken along the planar end surface 276) from the grip central axis 278 to the first apex 272 is different than a distance from the grip central axis 278 to the second apex 274. Accordingly, such an arrangement will accommodate users having varying hand sizes as well as varying gripping style preferences. More specifically, such an arrangement may be beneficial for use with a "Continental Grip," an "Eastern Forehand Grip," a "Semi-Western Forehand Grip," and/or an "Eastern Backhand Grip," as well as any combinations thereof. In this example, the sagittal plane may continue to bisect the dorsal cantle region 262 and/or the ventral cantle region 264.

Turning to FIGS. 3*a*-3*e*, a third example paddle 300 is provided. It is appreciated that the paddle 300 illustrated in FIGS. 3*a*-3*e* may include similar features to the paddles 100, 200 illustrated in FIGS. 1*a*-2*d*, and accordingly, elements illustrated in FIGS. 3*a*-3*e* are designated by similar reference numbers indicated in the embodiment illustrated in FIGS. 1*a*-2*d* increased by 100 or 200, respectively. Accordingly, these features will not be described in substantial detail. Further, it is appreciated that any of the elements described with regards to the paddles 100, 200 may be incorporated into the paddle 300.

Figure 3A:
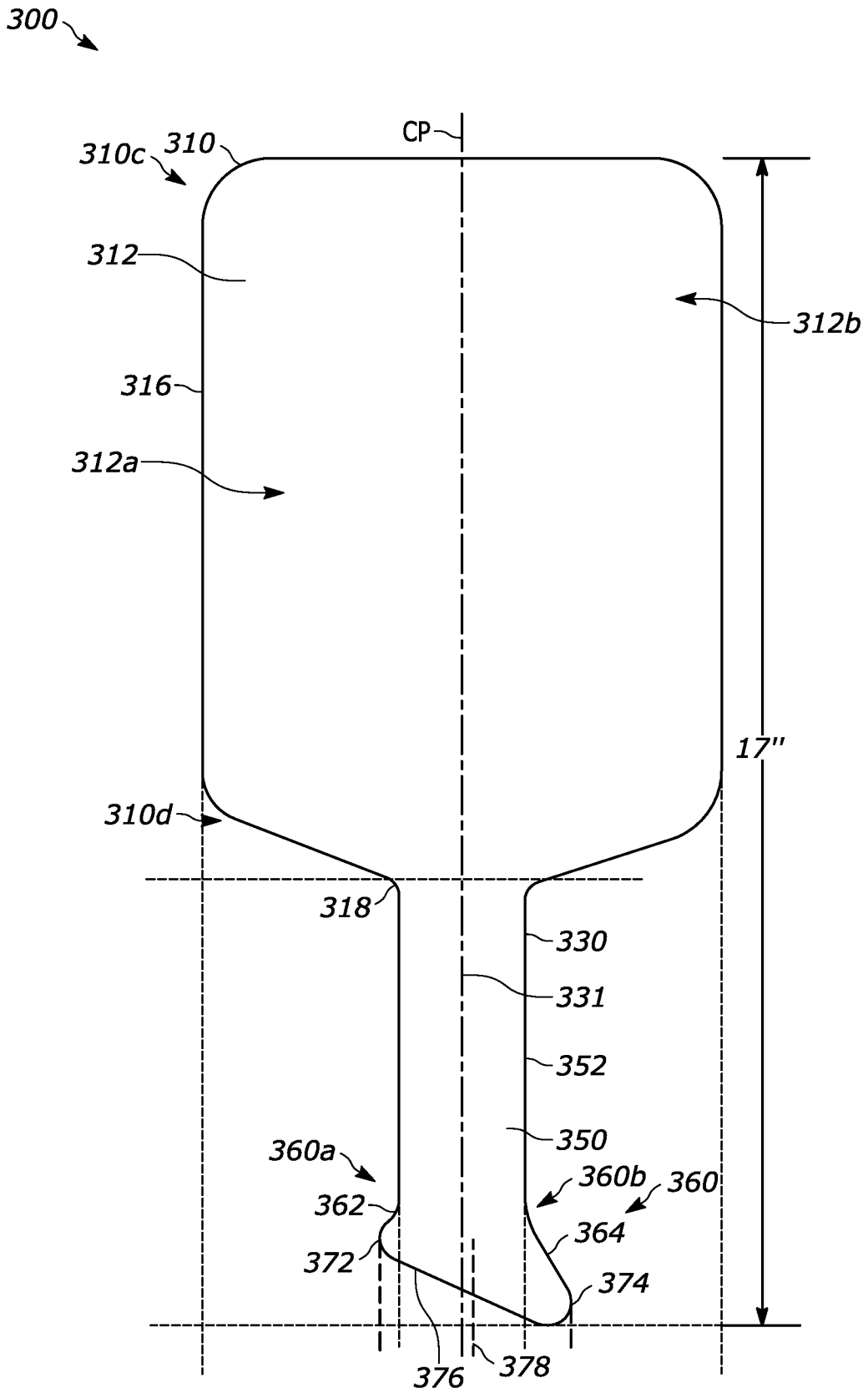
FIG. 3*a* illustrates a front elevation view of a third example sports implement in accordance with various embodiments.
Figure 3B:
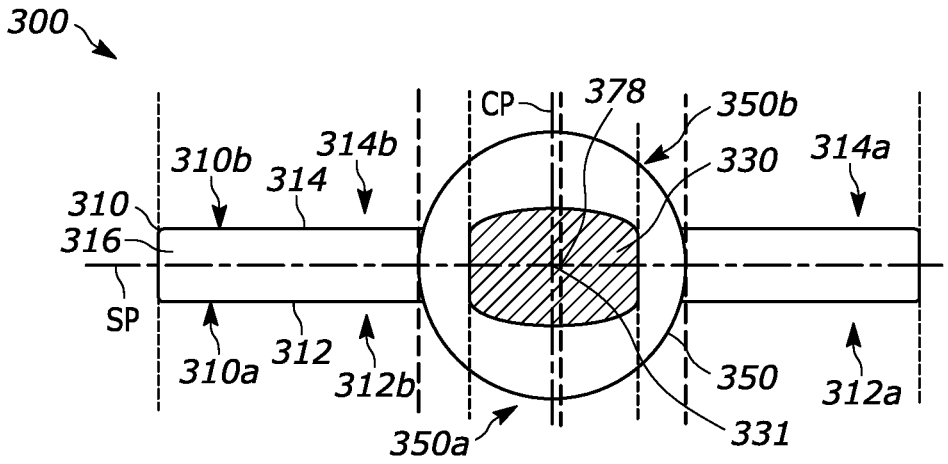
FIG. 3*b* illustrates a rear plan view of the example sports implement of FIG. 3*a* in accordance with various embodiments.
Figure 3C:
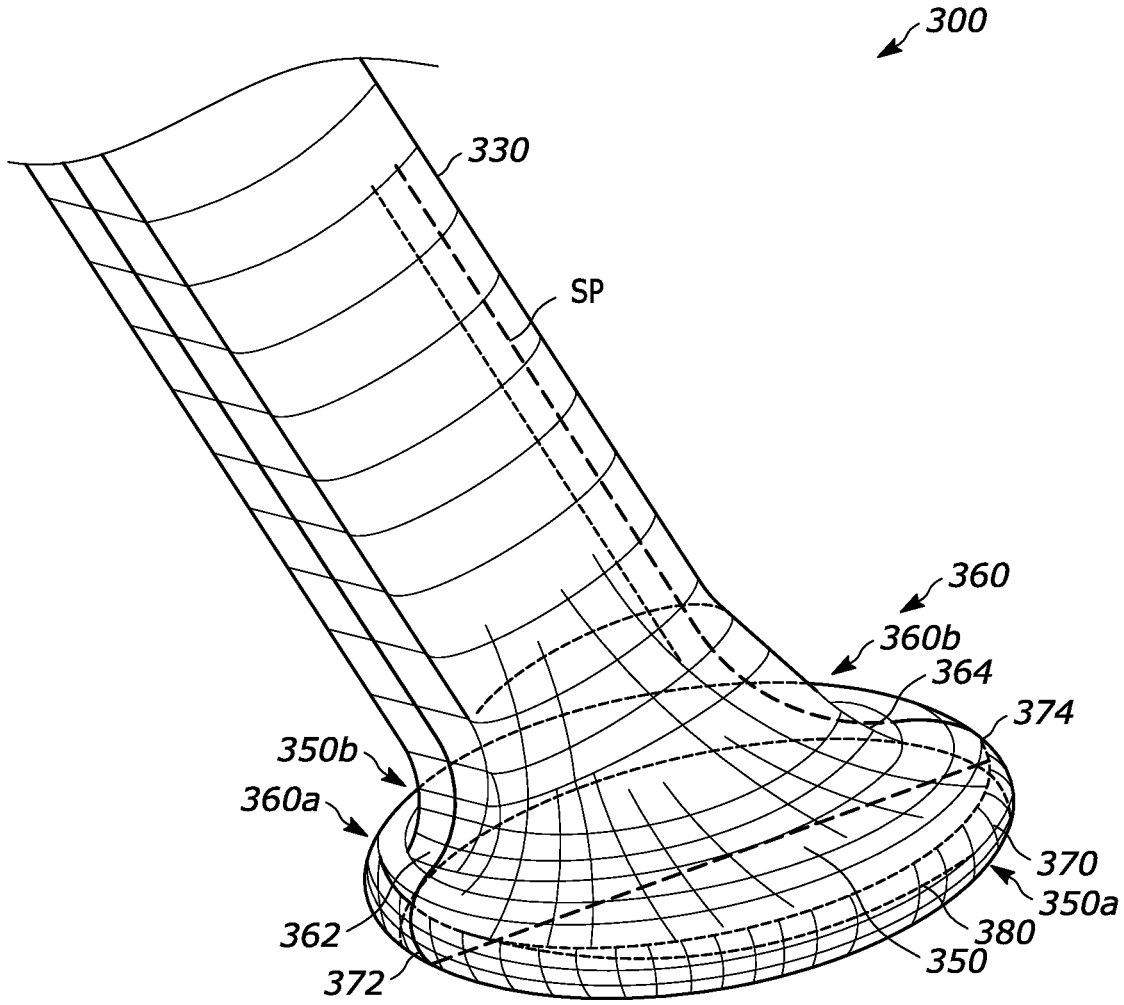
FIG. 3*c* illustrates a perspective view of a portion of the example sports implement of FIGS. 3*a* and 3*b* in accordance with various embodiments.
Figure 3E:
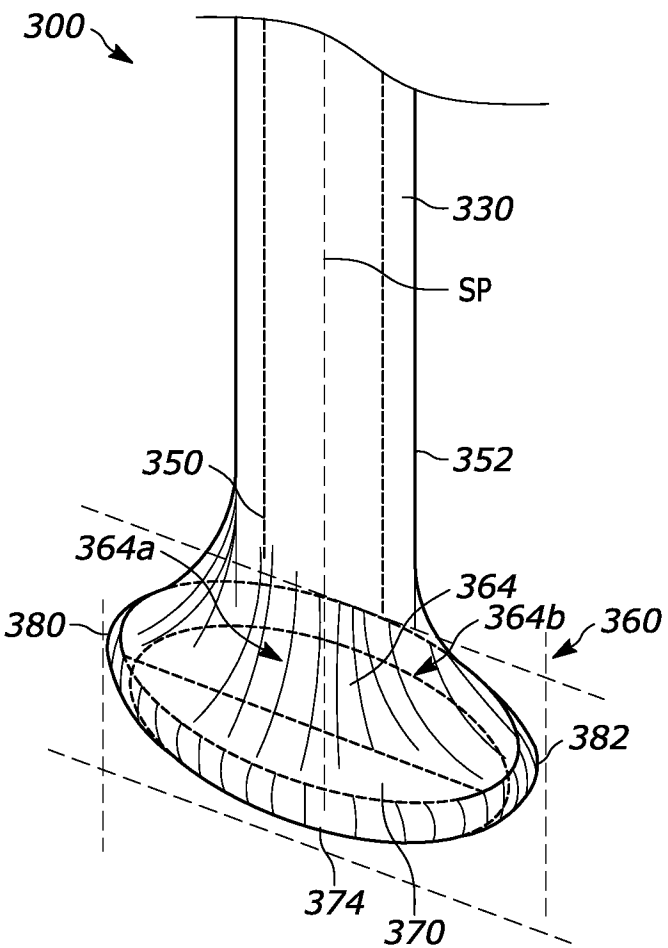
FIG. 3*e* illustrates a right side elevation view of a portion of the example sports implement of FIGS. 3*a*-3*d* in accordance with various embodiments.
Figure 3D:
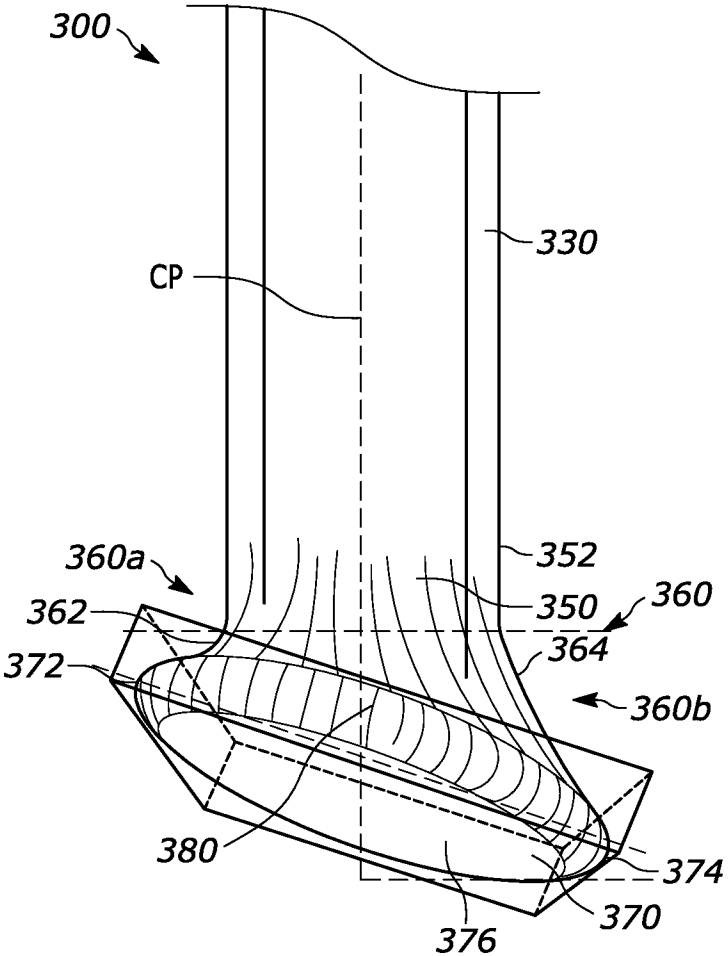
FIG. 3*d* illustrates a front elevation view of a portion of the example sports implement of FIGS. 3*a*-3*c* in accordance with various embodiments.

In this example, the grip member 350 is canted relative to the sagittal plane for left-handed or right-handed use. It is noted that in this example, while the grip central axis 378 is offset from the handle central axis 331, in some examples, the two axes 378, 331 may be collinear. With reference to FIGS. 3*d* and 3*e*, in this example, third and fourth apexes 380, 382 are illustrated, with the third apex 380 facing in a direction of the first side 310*a* of the main body portion 310 (and the first half 364*a* of the ventral cantle region 364) and the fourth apex 382 facing in a direction of the second side 310*b* of the main body portion 310 (and the second half 364*b* of the ventral cantle region 364).

Notably, the third apex 380 is disposed at a relatively higher (that is, closer to the extension location 318 of the main body portion 310) position than the fourth apex 382 such that the planar end surface 376 forms an obtuse angle (e.g., between approximately 91° and approximately 135°) with the sagittal plane. Accordingly, such a canted configuration of the grip member 370 may be of particular benefit for right-handed users, as an increased surface area of the ventral cantle region 364 on the second half 364*c* may improve a user's right-handed grip. It is appreciated that an opposite configuration (not illustrated) may be provided where the grip member is canted in the opposite direction such that the fourth apex is positioned higher (that is, closer to the extension location of the main body portion) than the third apex to accommodate left-handed users.

Turning to FIGS. 4*a*-4*j*, a fourth example paddle 400 is provided. It is appreciated that the paddle 400 illustrated in FIGS. 4*a*-4*j* may include similar features to the paddles 100, 200, 300 illustrated in FIGS. 1*a*-3*e*, and accordingly, elements illustrated in FIGS. 4*a*-4*j* are designated by similar reference numbers indicated in the embodiment illustrated in FIGS. 1*a*-3*e* increased by 100, 200, or 300, respectively. Accordingly, these features will not be described in substantial detail. Further, it is appreciated that any of the elements described with regards to the paddles 100, 200, 300 may be incorporated into the paddle 400.

Figure 4A:
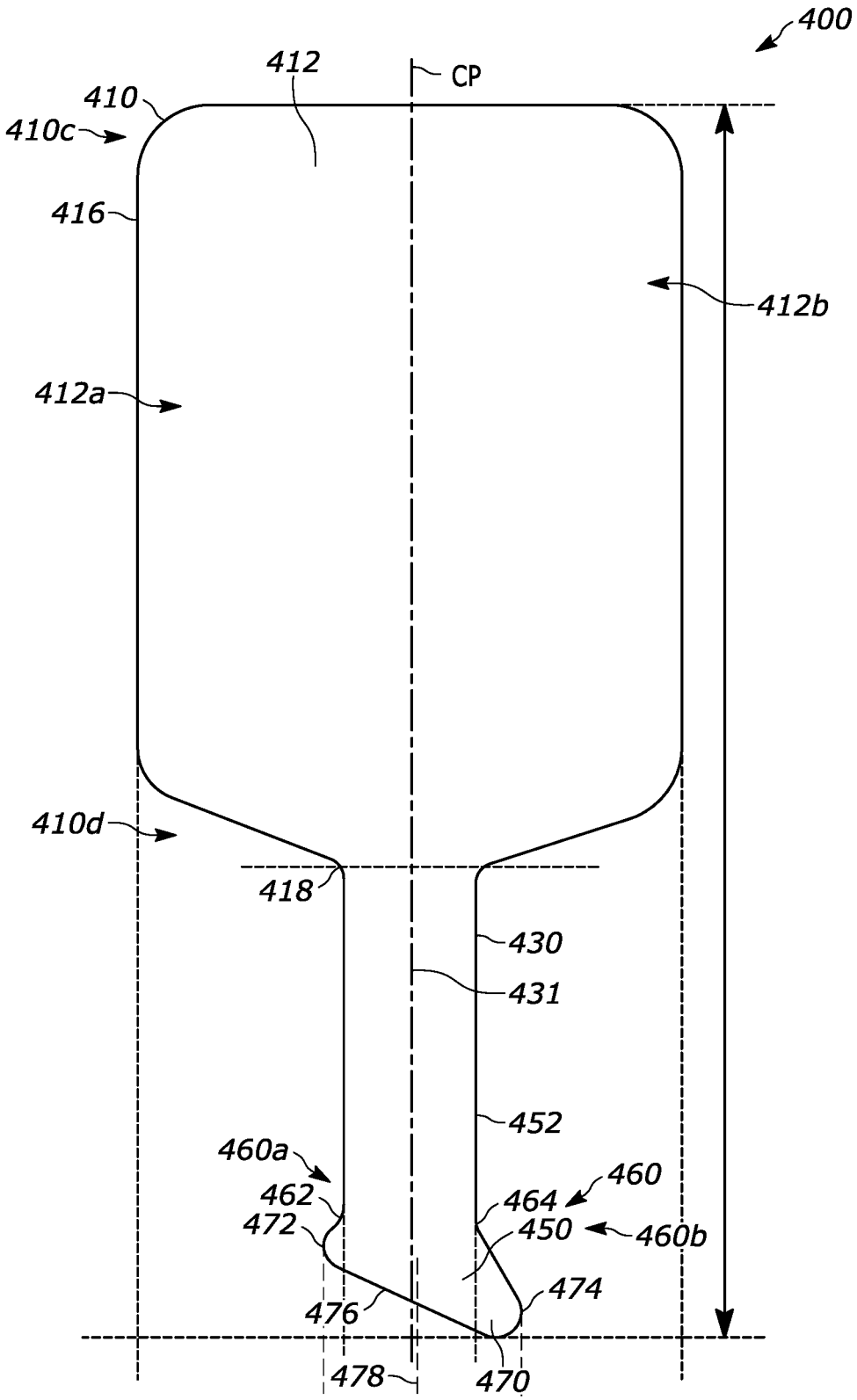
FIG. 4*a* illustrates a front elevation view of a fourth example sports implement in accordance with various embodiments.
Figure 4B:
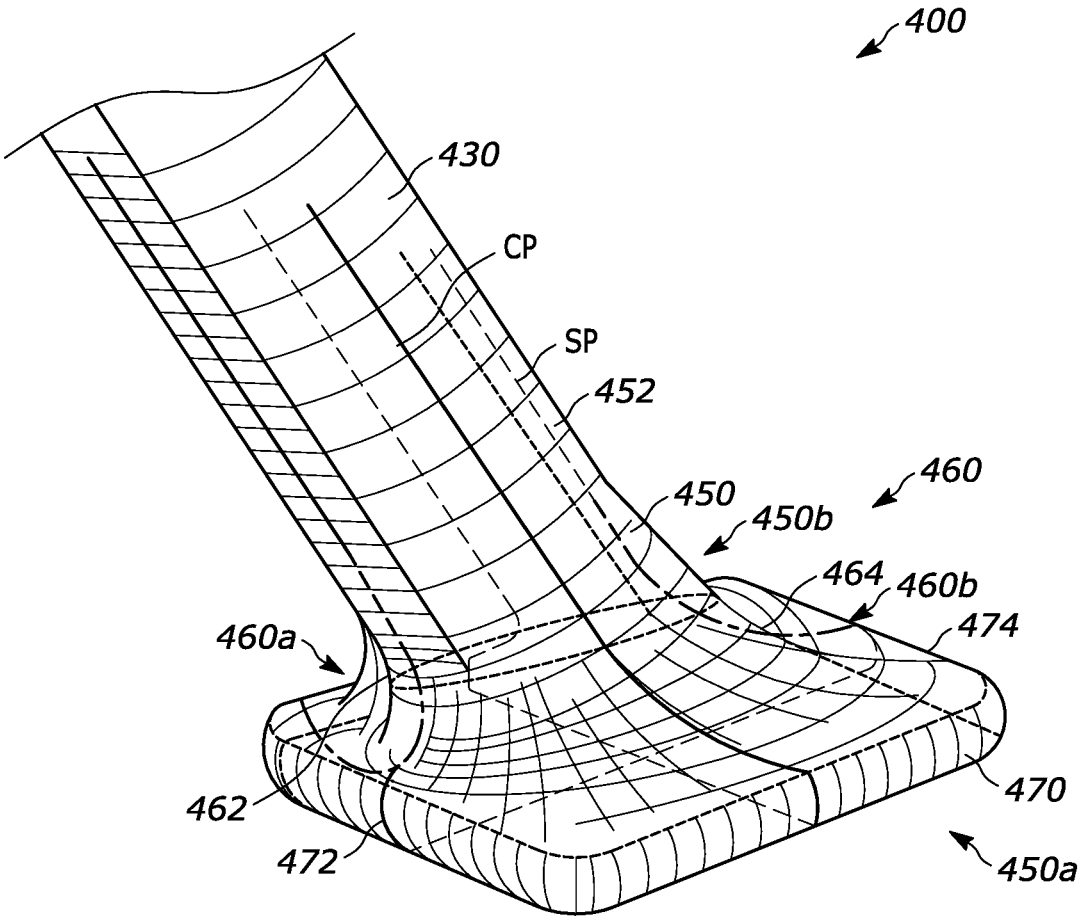
FIG. 4*b* illustrates a perspective view of a portion of the example sports implement of FIG. 4*a* having a rounded square-shaped end in accordance with various embodiments.
Figure 4C:
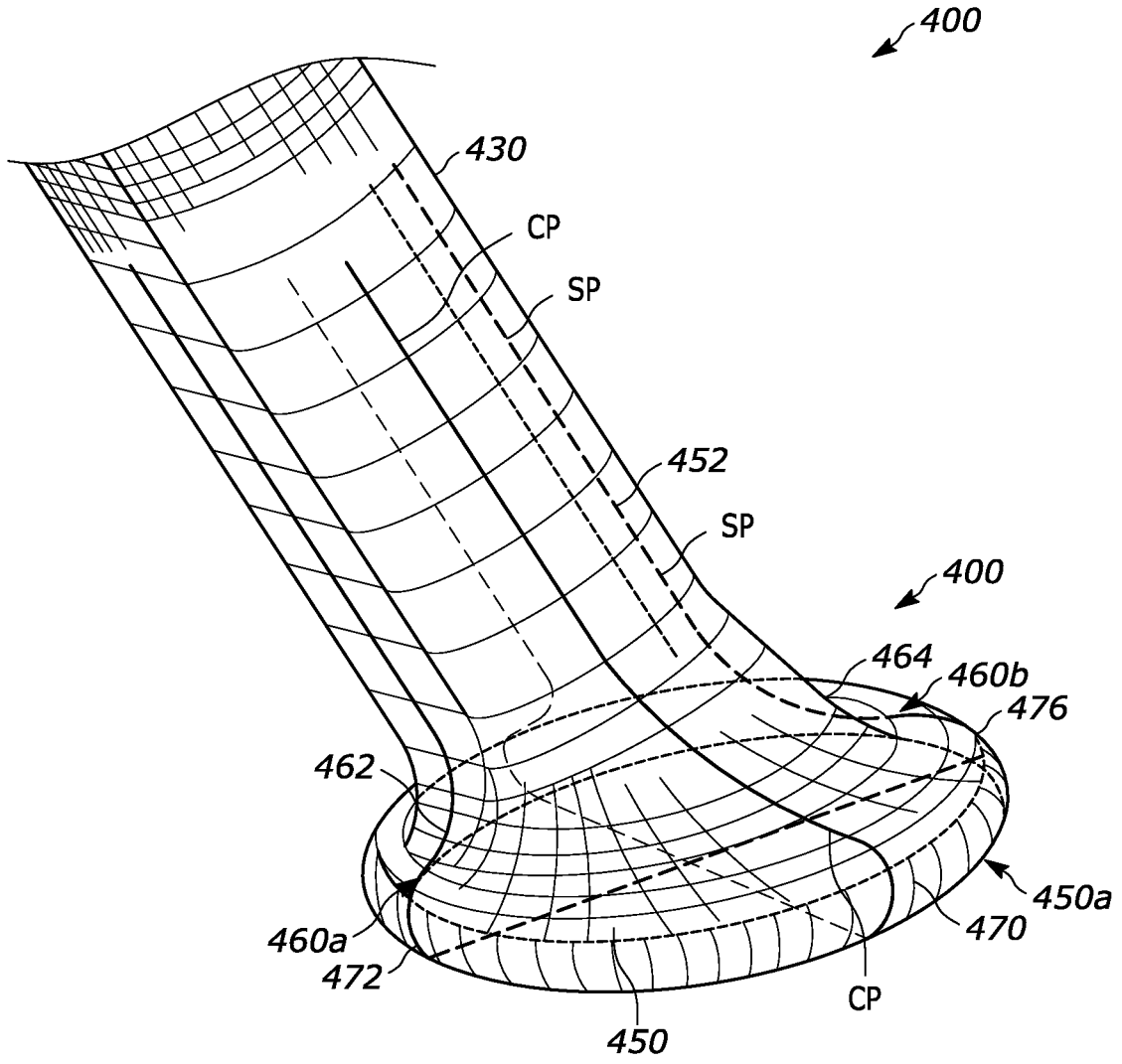
FIG. 4*c* illustrates a perspective view of a portion of the example sports implement of FIG. 4*a* having a hatchet handle-shaped end in accordance with various embodiments.
Figure 4E:
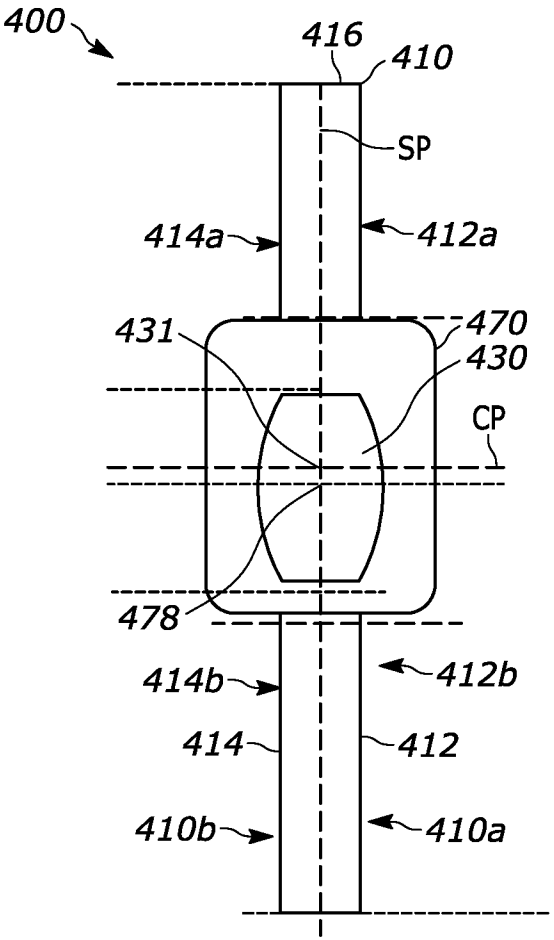
FIG. 4*e* illustrates a rear plan view of the example sports implement of FIGS. 4*a* and 4*b* having the rounded square-shaped end in accordance with various embodiments.
Figure 4D:
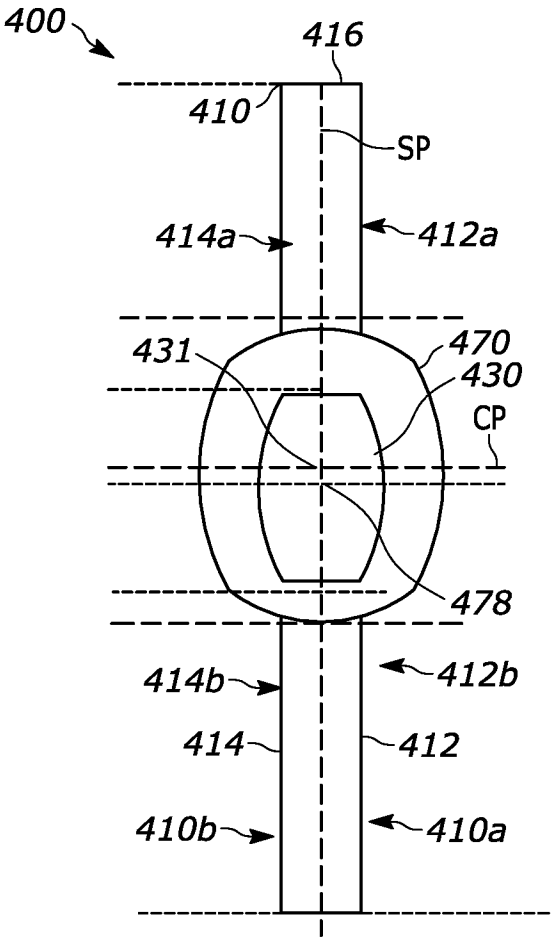
FIG. 4*d* illustrates a rear plan view of the example sports implement of FIG. 4*a* having an oval-shaped end in accordance with various embodiments.
Figure 4G:
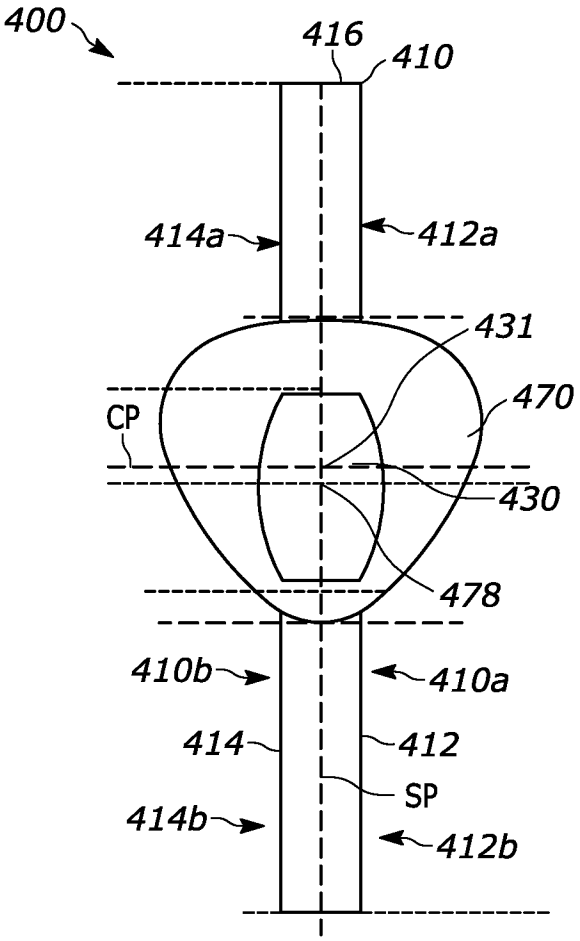
FIG. 4*g* illustrates a rear plan view of the example sports implement of FIG. 4*a* having an eccentric rotary-shaped end in accordance with various embodiments.
Figure 4F:
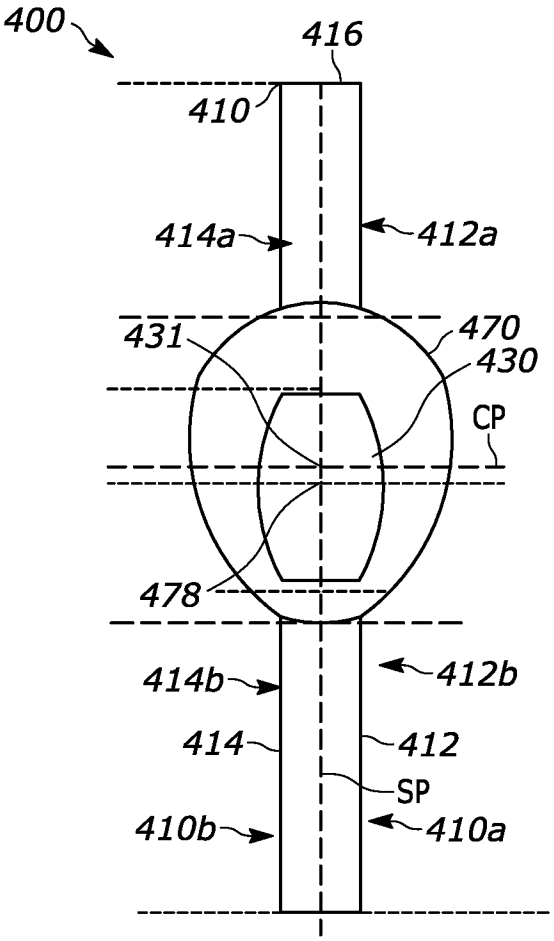
FIG. 4*f* illustrates a rear plan view of the example sports implement of FIGS. 4*a* and 4*c* having the hatchet handle-shaped end in accordance with various embodiments.
Figure 4J:
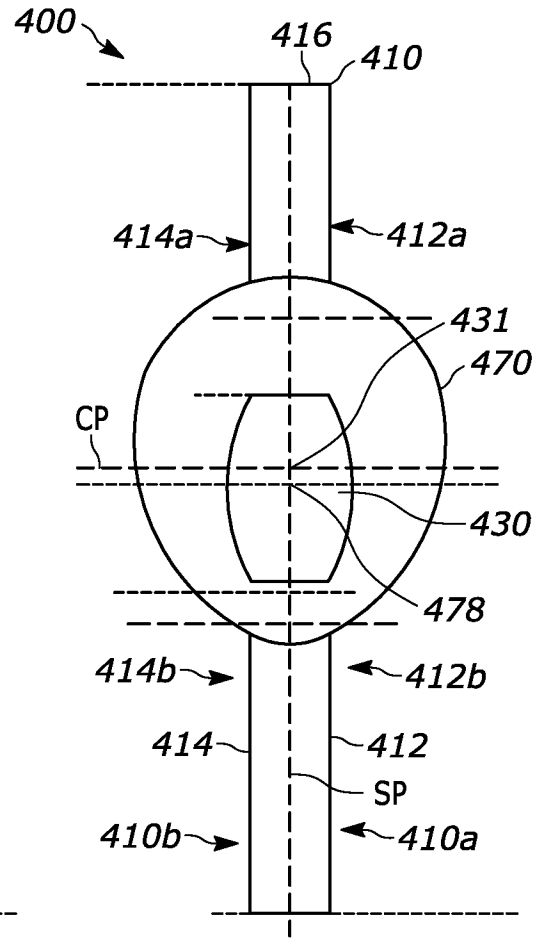
FIG. 4*j* illustrates a rear plan view of the example sports implement of FIG. 4*a* having an enlarged end in accordance with various embodiments.
Figure 4I:
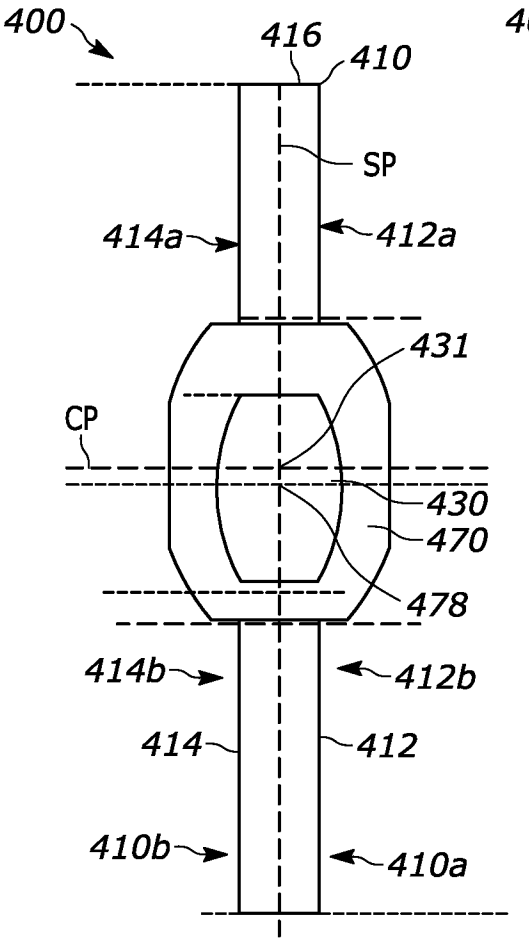
FIG. 4*i* illustrates a rear plan view of the example sports implement of FIG. 4*a* having an ellipsoidal-shaped end in accordance with various embodiments.
Figure 4H:
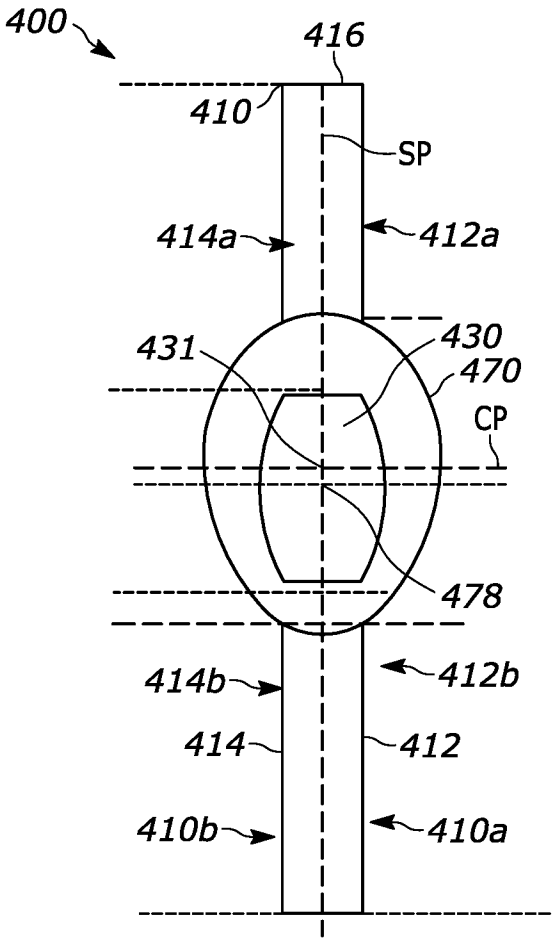
FIG. 4*h* illustrates a rear plan view of the example sports implement of FIG. 4*a* having an egg-shaped end in accordance with various embodiments.

In this example, the grip end portion 470 may be provided with a number of differently shaped ends. It is noted that in this example, while the grip central axis 478 is offset from the handle central axis 431, in some examples, the two axes 478, 431 may be collinear. With reference to FIGS. 4*b* and 4*e*, the grip end 470 may have a rounded square-shaped configuration. With reference to FIGS. 4*c* and 4*f*, the grip end 470 may have a hatchet handle-shaped configuration. With reference to FIG. 4*d*, the grip end 470 may have an oval-shaped configuration. With reference to FIG. 4*g*, the grip end 470 may have an eccentric rotary-shaped configuration. With reference to FIG. 4*h*, the grip end 470 may have an egg-shaped configuration. With reference to FIG. 4*i*, the grip end 470 may have an ellipsoidal-shaped configuration. With reference to FIG. 4*j*, the grip end 470 may have an enlarged end configuration. Any one or ones of these grip ends may be used as desired to increase user comfort, power, and/or accuracy. In any of these examples, the configurations of the grip end 470 may be reversed, mirrored, or "flipped" about any desired axis or plane. Such a configuration may increase surface contact with different regions of the user's hand, thereby increasing the user's ability to apply increased amounts of force to the sports implement. Other examples are possible. The grip ends may have varying outer perimeter dimensions such as, for example between approximately 3.5" and approximately 9.5".

Turning to FIGS. 5*a*-5*e*, a fifth example paddle 500 is provided. It is appreciated that the paddle 500 illustrated in FIGS. 5*a*-5*e* may include similar features to the paddles 100, 200, 300, 400 illustrated in FIGS. 1*a*-4*j*, and accordingly, elements illustrated in FIGS. 5*a*-5*e* are designated by similar reference numbers indicated in the embodiment illustrated in FIGS. 1*a*-4*j* increased by 100, 200, 300, or 400, respectively. Accordingly, these features will not be described in substantial detail. Further, it is appreciated that any of the elements described with regards to the paddles 100, 200, 300, 400 may be incorporated into the paddle 500.

Figure 5A:
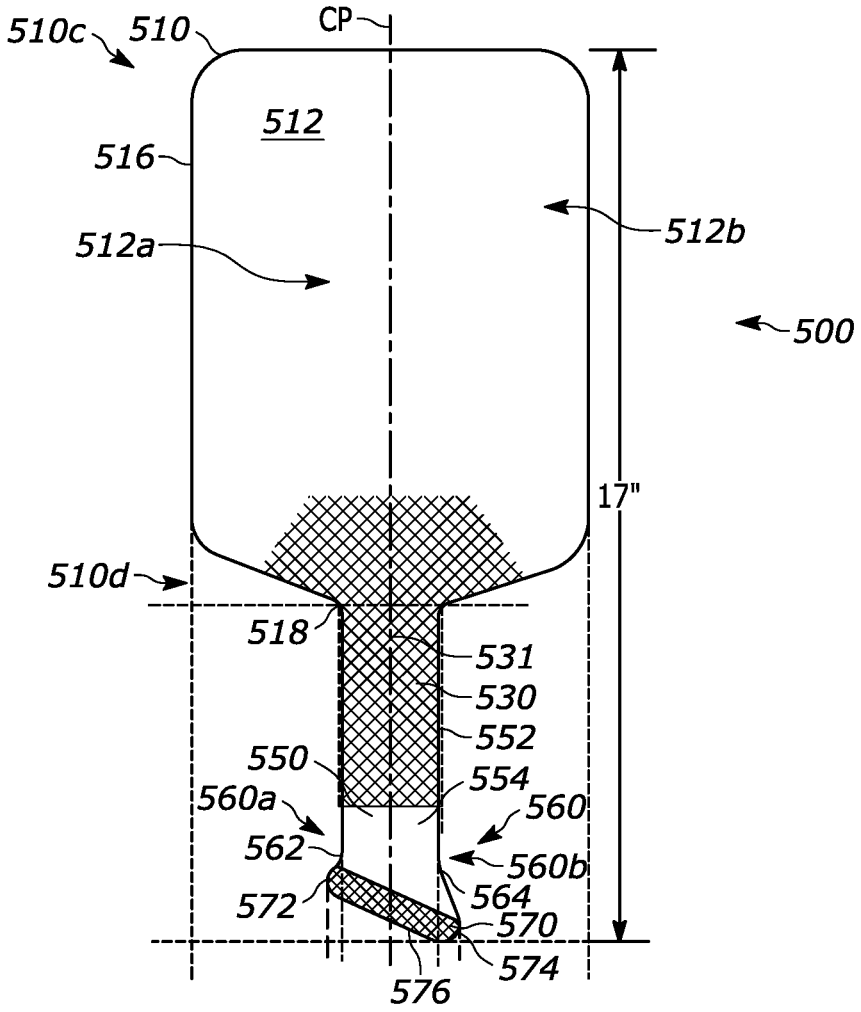
FIG. 5*a* illustrates a front elevation view of a fifth example sports implement having an example sleeve grip in accordance with various embodiments.
Figure 5B:
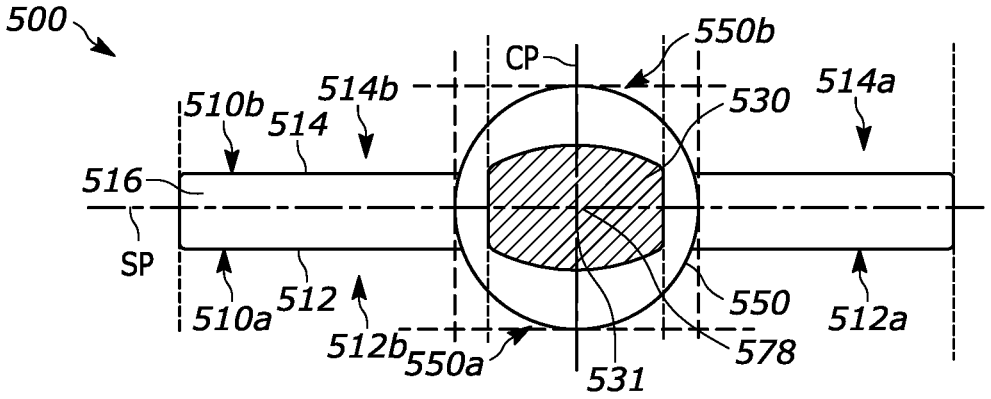
FIG. 5*b* illustrates a rear plan view of the example sports implement of FIG. 5*a* in accordance with various embodiments.
Figure 5C:
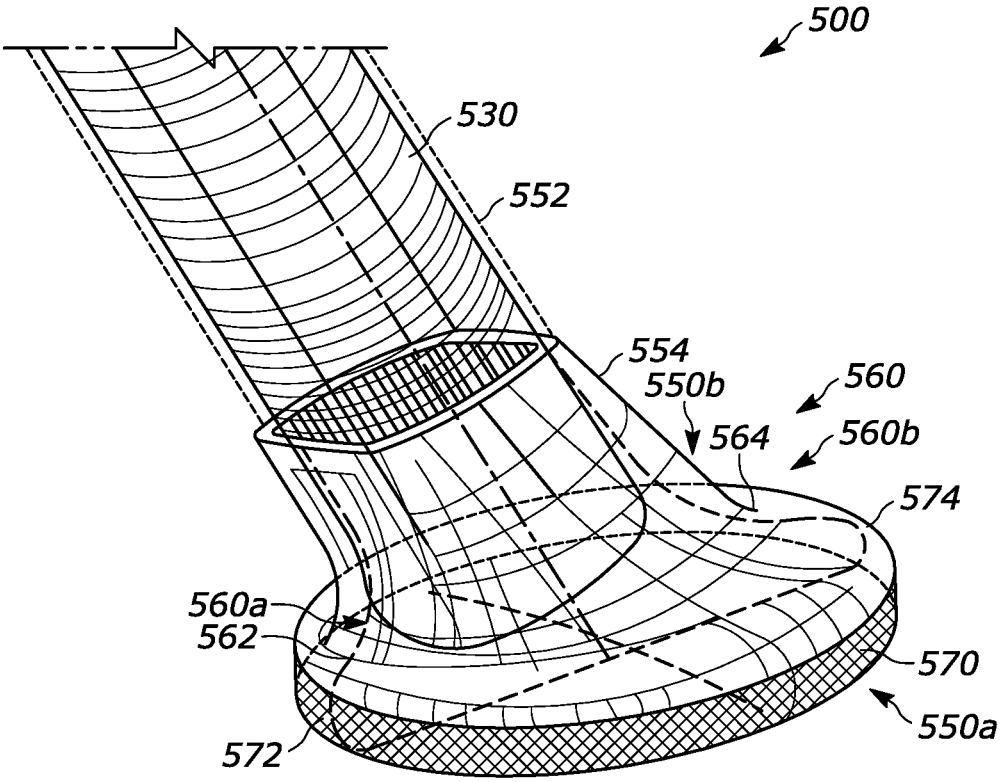
FIG. 5*c* illustrates a perspective view of a portion of the example sports implement of FIGS. 5*a* and 5*b* in accordance with various embodiments.
Figure 5D:
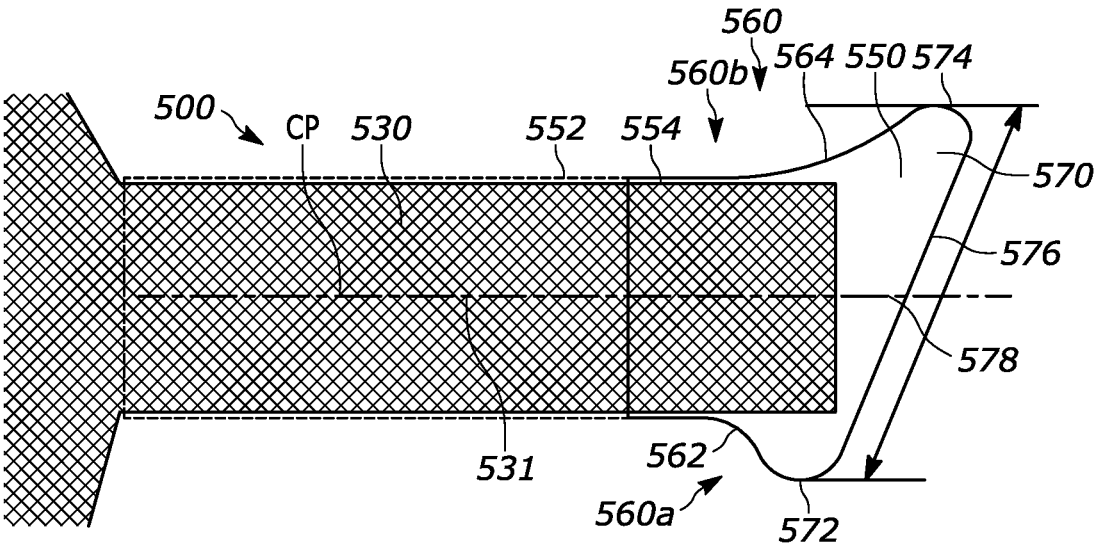
FIG. 5*d* illustrates a front elevation view of a portion of the example sports implement of FIGS. 5*a*-5*c* in accordance with various embodiments.
Figure 5E:
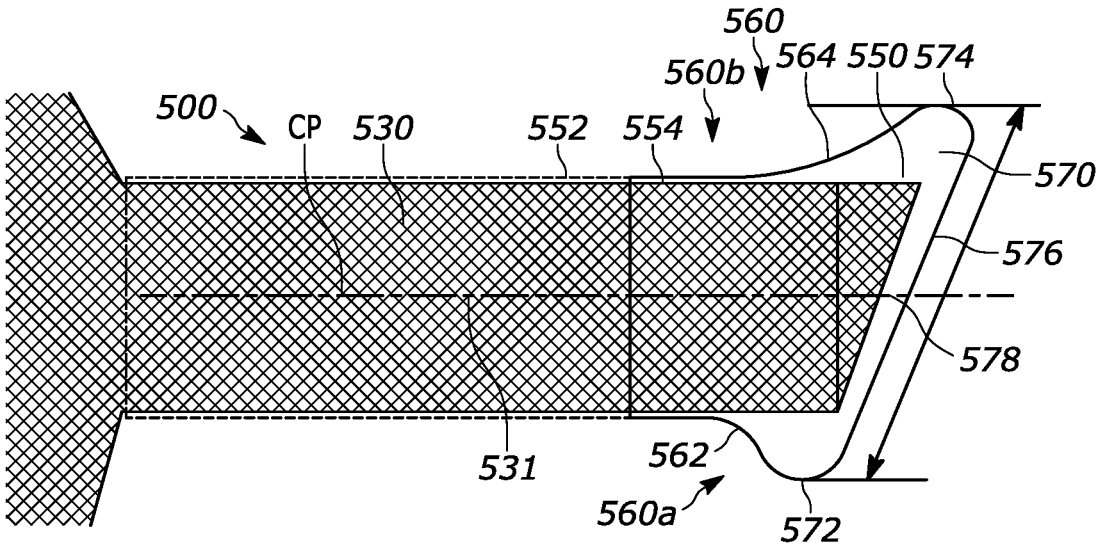
FIG. 5*e* illustrates a front elevation view of a portion of an alternative example sports implement in accordance with various embodiments.

In this example, the grip member 550 may be provided as an accessory that may removably slide onto or otherwise couple with the handle portion 530. It is noted that in this example, while the grip central axis 578 is collinear with the handle central axis 531, in some examples, the two axes 578, 531 may be offset from each other. In this example, the grip body portion 552 of the grip member 550 may be in the form of a cap portion 554 that defines the transition region 560 and the grip end portion 570. In some examples, the grip member 550 may include an elongated sleeve portion 552 to improve coupling of the grip member 550 with the handle portion 550. As illustrated in FIG. 5*d*, in this example, the sleeve portion 552 extends over all or most of the handle portion 530 and terminates at the extension location 518. The grip member 550 may couple with the handle portion 530 via any number of suitable approaches such as, for example, via a friction fit connection, via adhesives, via fasteners, and/or via a threaded coupling. Other examples are possible. As illustrated in FIG. 5*e*, the handle portion 530 may have an angled end portion that is parallel or approximately parallel to the planar end surface 576 of the grip member 550. In this example, the inner cavity of the cap portion 554 may have a similarly angled opening lower surface that corresponds with the angled end portion of the handle portion 530. Such an arrangement may improve and/or increase the mechanical connection between the grip member 550 and the paddle 500. Further, in some examples, such an arrangement may reduce weight of the grip member 550 due to the use of less material, which may advantageously move the center of gravity of the paddle 500. Further examples of a sleeve arrangement are described in U.S. patent application Ser. No. 15/325,812, filed Jan. 12, 2017, the entire contents of which are incorporated by reference herein.

Turning to FIGS. 6*a*-6*c*, a sixth example paddle 600 is provided. It is appreciated that the paddle 500 illustrated in FIGS. 6*a*-6*c* may include similar features to the paddles 100, 200, 300, 400, 500 illustrated in FIGS. 1*a*-5*d*, and accordingly, elements illustrated in FIGS. 6*a*-6*c* are designated by similar reference numbers indicated in the embodiment illustrated in FIGS. 1*a*-5*d* increased by 100, 200, 300, 400, or 500, respectively. Accordingly, these features will not be described in substantial detail. Further, it is appreciated that any of the elements described with regards to the paddles 100, 200, 300, 400, 500 may be incorporated into the paddle 600.

In this example, the grip body portion 652 of the grip member 650 may include a number of finger positioning members 653 to assist with gripping and positioning the user's hand on the paddle 600. Such grip positioning members 653 may additionally increase user comfort and limit user fatigue.

Figure 7B:
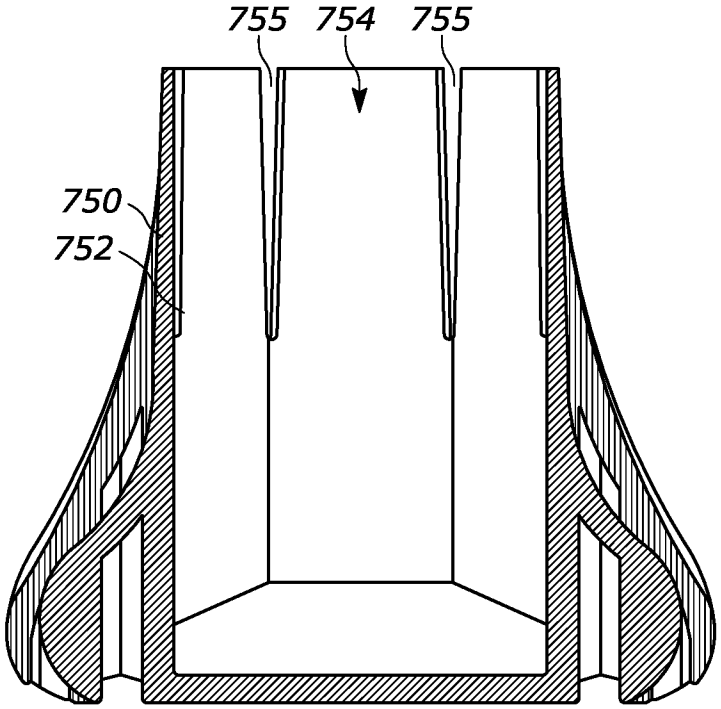
FIG. 7*b* illustrates a right side elevation view of the example grip member of FIG. 7*a* in accordance with various embodiments.
Figure 7A:
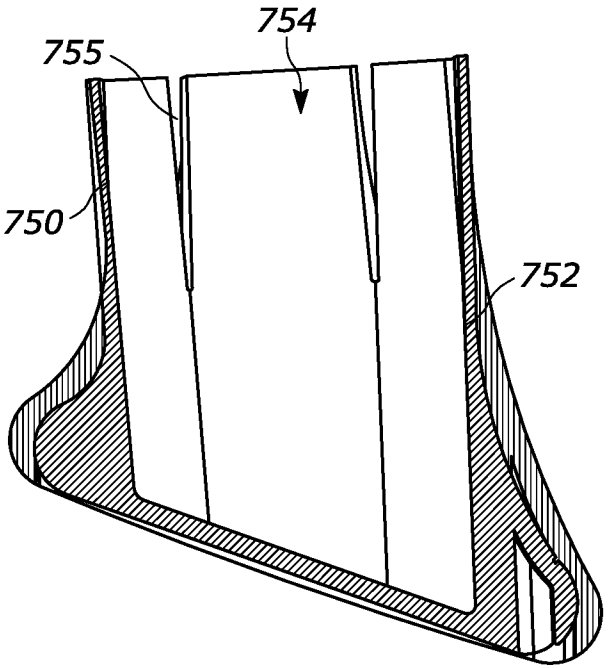
FIG. 7*a* illustrates a front elevation view of a portion of an example grip member for use with an example sports implement in accordance with various embodiments.

Turning to FIGS. 7*a* and 7*b*, a seventh example grip member 750 is provided. It is appreciated that the grip member 750 illustrated in FIGS. 7*a* and 7*b* may include similar features to features in the paddles 100, 200, 300, 400, 500, illustrated in FIGS. 1*a*-6*c*, and accordingly, elements illustrated in FIGS. 7*a* and 7*b* are designated by similar reference numbers indicated in the embodiment illustrated in FIGS. 1*a*-6*c* increased by respective multiples of 100. Accordingly, these features will not be described in substantial detail. Further, it is appreciated that any of the elements described with regards to the paddles 100, 200, 300, 400, 500, 600 may be incorporated into or on the grip member 750.

The grip member 750 may be provided as an aftermarket and/or retrofit accessory for a paddle which may accommodate paddles of varying dimensions and/or configurations. More specifically, the grip 750 may include a grip body 752 defining an interior cavity 754 that receives at least a portion of a desired handle portion of a paddle (not illustrated). The grip body 752 may include any number of slits or openings 755 that may allow paddles of varying shapes, sizes, and/or configurations to be received within the interior cavity 754 of the grip member 750. More specifically, the slits or openings 755 may cause the grip body 752 to splay outwardly from the longitudinal axis thereof, thus creating a slightly larger internal dimension (e.g., internal diameter and/or circumference). Upon the handle portion being inserted therein, a user may squeeze the grip body 752 and apply an adhesive (e.g., grip tape) about the periphery thereof to form a completed paddle. In some examples, the grip member 750 may include an engagement member (e.g., a protrusion or a notch) that engages a corresponding portion of the handle portion of the paddle to form a secure connection therewith. Other examples are possible.

As illustrated in FIGS. 7*a* and 7*b*, in some implementations, the grip body 752 may additionally include cutouts or openings at various locations (e.g., the bottom surface) that may reduce the weight of the grip member 750, thereby modifying the moment of inertia of the paddle. Any arrangement or configuration of cutouts or openings may be envisioned.

It will be appreciated that any number of alternative paddle shapes and dimensions of the main body portion may be used. More specifically, with reference to FIGS. 8-11, alternative example paddles 800, 900, 1000, 1100 are provided. It is appreciated that these paddles 800, 900, 1000, 1100 illustrated in FIGS. 8-11 may include similar features to the paddles 100, 200, 300, 400, 500, 600, 700 illustrated in FIGS. 1*a*-7*b*, and accordingly, elements illustrated in FIGS. 8-11 are designated by similar reference numbers indicated in the embodiment illustrated in FIGS. 1*a*-7*b* increased by respective multiples of 100. Accordingly, these features will not be described in substantial detail. Further, it is appreciated that any of the elements described with regards to the paddles 100, 200, 300, 400, 500, 600, 700 may be incorporated into the paddles 800, 900, 1000, 1100.

Figure 8:
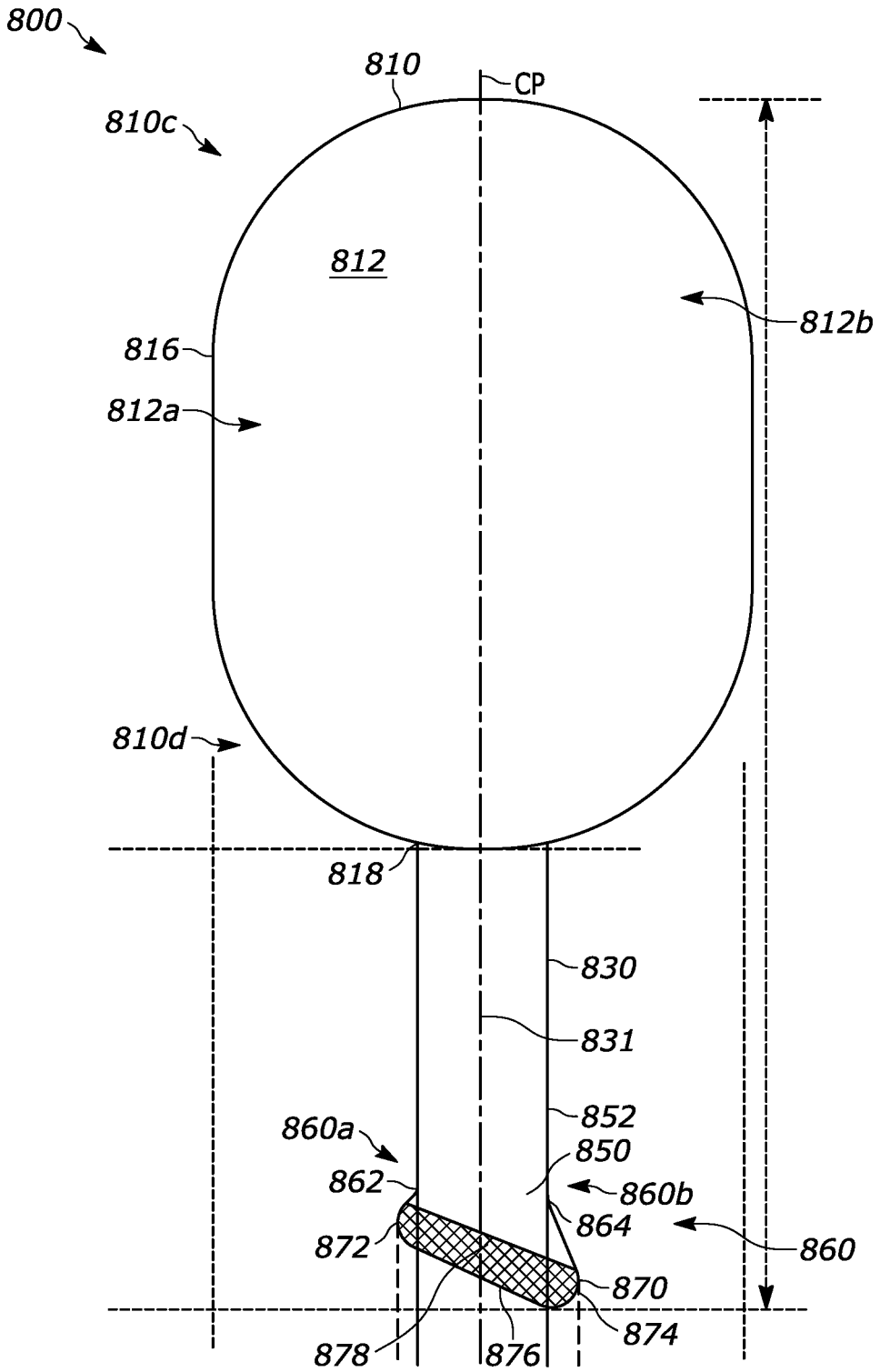
FIG. 8 illustrates a front elevation view of a seventh example sports implement in accordance with various embodiments.

As illustrated in FIG. 8, the paddle 800 includes a generally oval or ovoid main body portion 810. In some examples (not illustrated), the main body portion 810 may be elongated, and in other examples, the main body portion 810 may be shortened as desired.

Figure 9:
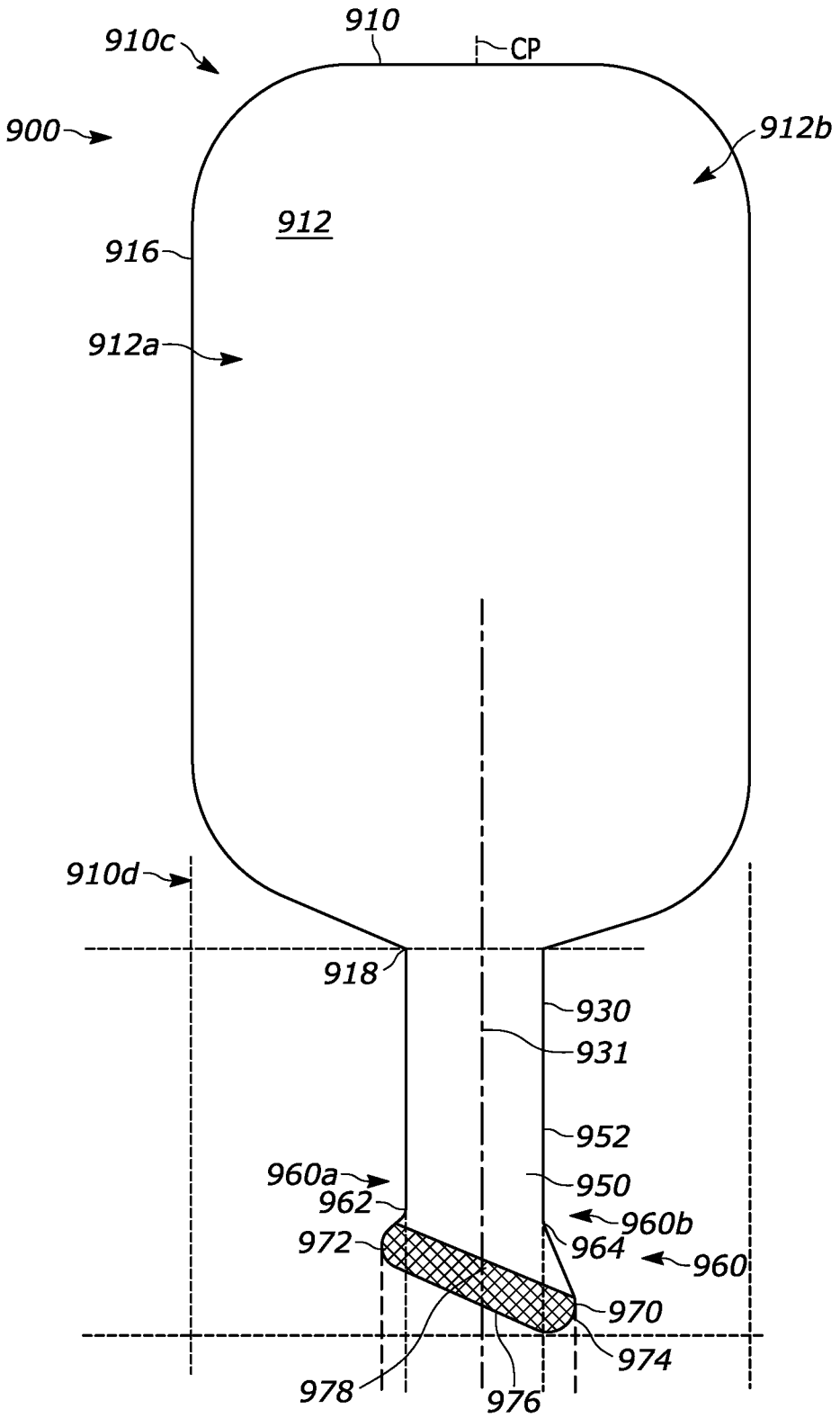
FIG. 9 illustrates a front elevation view of an eighth example sports implement in accordance with various embodiments.

As illustrated in FIG. 9, the paddle 900 includes a generally rectangular main body portion 910 having pronounced curved corners. In some examples (not illustrated), the main body portion 910 may be elongated, and in other examples, the main body portion 910 may be shortened as desired.

Figure 10:
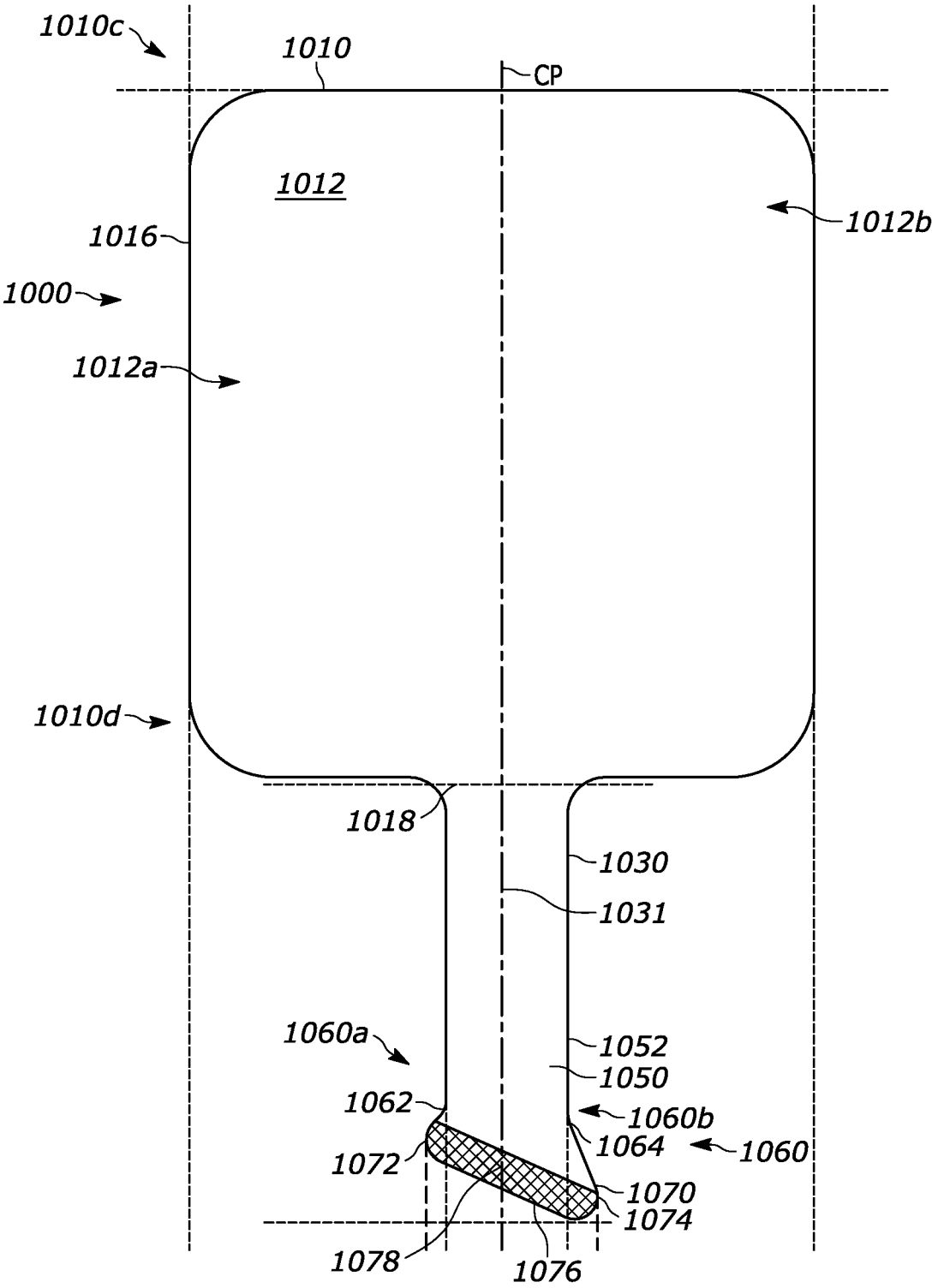
FIG. 10 illustrates a front elevation view of a ninth example sports implement in accordance with various embodiments.

As illustrated in FIG. 10, the paddle 1000 includes a generally square main body portion 1010. In some examples (not illustrated), the main body portion 1010 may be elongated, and in other examples, the main body portion 1010 may be shortened as desired.

Figure 11:
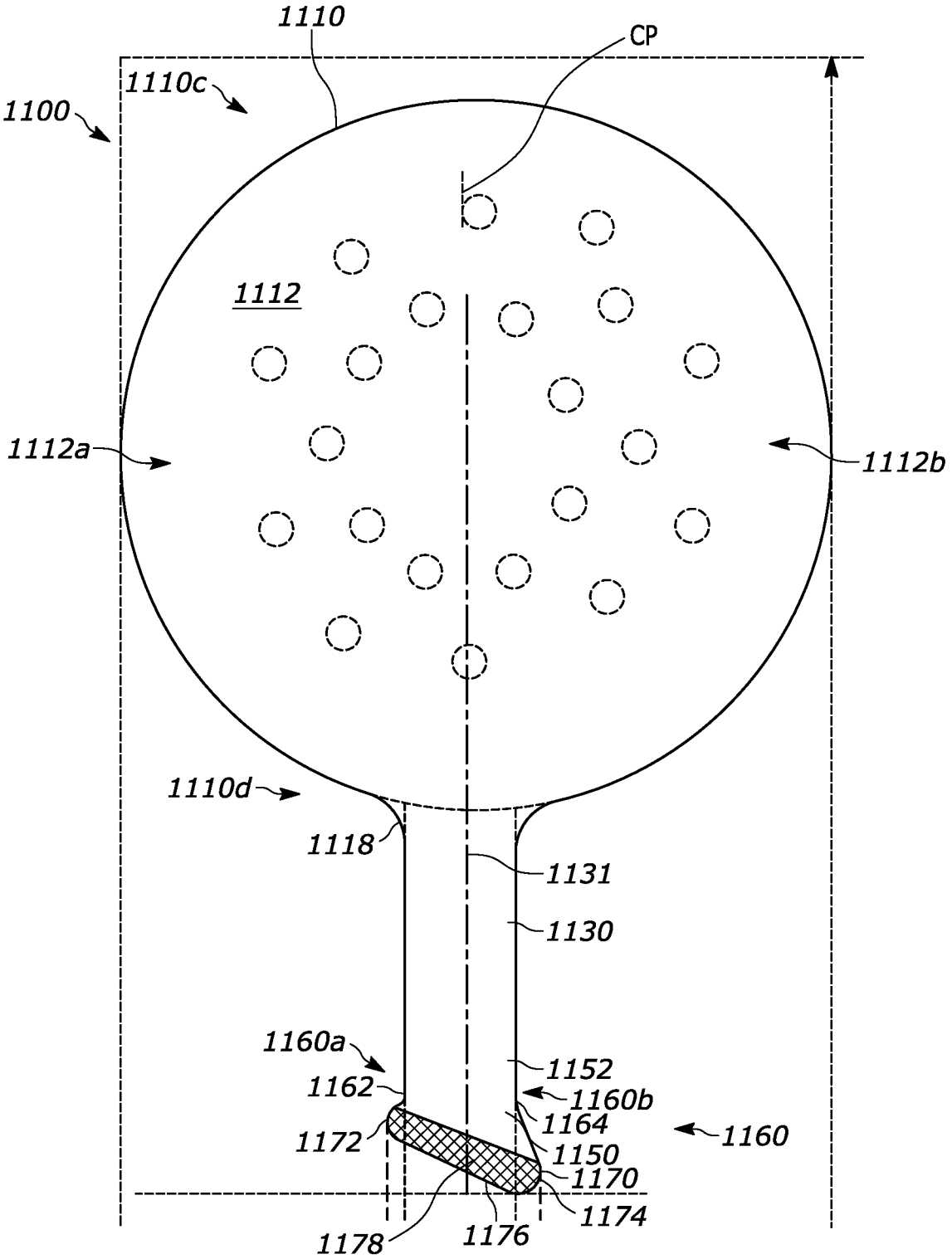
FIG. 11 illustrates a front elevation view of a tenth example sports implement in accordance with various embodiments.

As illustrated in FIG. 11, the paddle 1100 includes a generally circular main body portion 1110 having a generally continuous curvature. In some examples, (not illustrated), the main body portion 1110 may be elongated such that is egg or oval-shaped, and in other examples, the main body portion 1110 may be condensed as desired.

Figure 12:
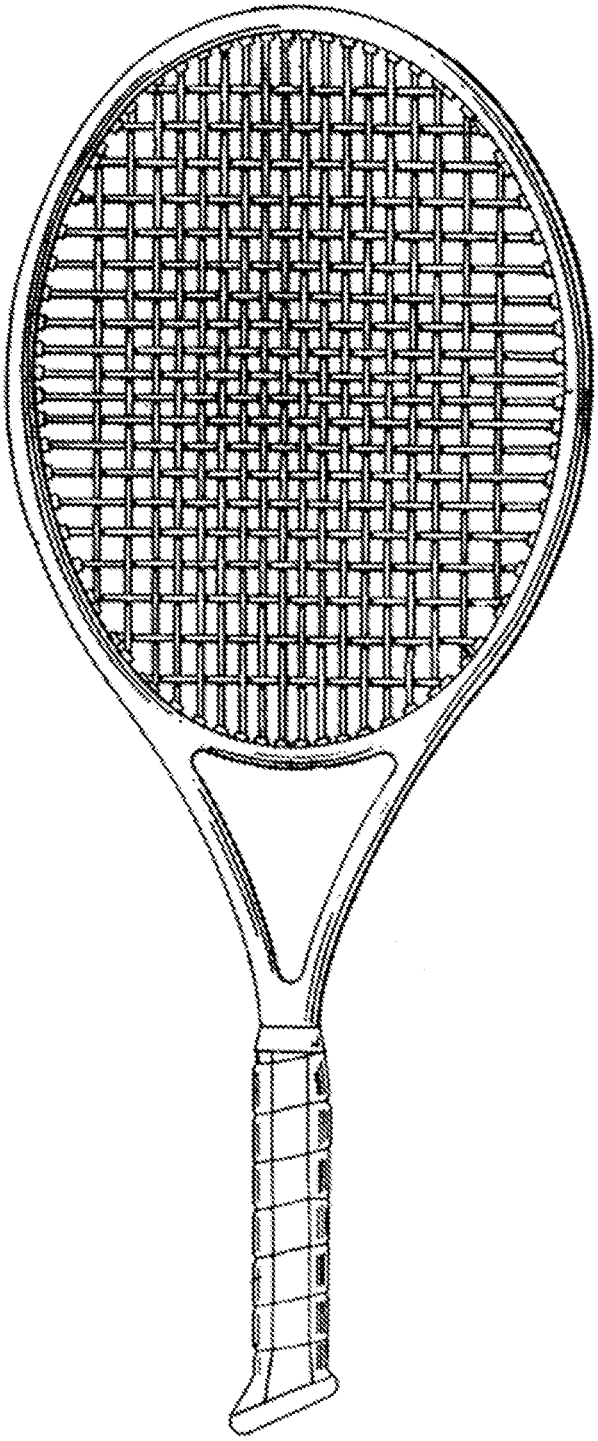
FIG. 12 illustrates a front elevation view of an eleventh example sports implement in accordance with various embodiments.

In any of these examples, the grip member may be wrapped or covered with grip tape or any other suitable material as desired. Further, it is appreciated that the grip members described herein may be suitable for use for similar sports implements having first and second contact surfaces and where ventral cantle and dorsal cantle regions are divided by a sagittal plane disposed between these surfaces. Such examples may include tennis rackets (as illustrated in FIG. 12), badminton rackets, table tennis rackets, platform tennis rackets, ping pong paddles, and the like. Other examples are possible.

Unless specified otherwise, any of the feature or characteristics of any one of the embodiments of the self-massaging tool disclosed herein may be combined with the features or characteristics of any other embodiments of the self-massaging tool. Those skilled in the art will recognize that a wide variety of modifications, alterations, and combinations can be made with respect to the above described embodiments without departing from the scope of the disclosure, and that such modifications, alterations, and combinations are to be viewed as being within the ambit of the inventive concept.

The patent claims at the end of this patent application are not intended to be construed under 35 U.S.C. § 112(f) unless traditional means-plus-function language is expressly recited, such as "means for" or "step for" language being explicitly recited in the claim(s).

What is claimed is:

1. A sports implement comprising:

a main body portion having a first contact surface, a second contact surface, and a sidewall positioned about a perimeter of each of the first and the second contact surfaces;

a handle portion extending from the main body portion, the handle portion defining a handle central axis extending therethrough;

a grip member including a grip body portion and a grip end portion, the grip body portion being operably coupled with the handle portion, the grip end portion ending at a generally planar grip end surface defining a grip central axis extending centrally therethrough; and a transition region between the grip body portion and the grip end portion, the transition region having a first side defining a dorsal cantle region and a second side defining a ventral cantle region;

wherein at the grip end surface, the handle central axis is offset from and parallel to the grip central axis.

2. The sports implement of claim 1, wherein the first contact surface comprises a left side of the main body portion and the second contact surface comprises a right side of the main body portion, the first and second contact surfaces being generally planar.

3. The sports implement of claim 1, further comprising a plane extending through the sidewall upon which each of the handle central axis and the grip central axis are disposed.

4. The sports implement of claim 3, wherein at least one of the dorsal cantle region and the ventral cantle region bisects or divides the plane.

5. The sports implement of claim 4, wherein at least one of the dorsal cantle region or the ventral cantle region is canted relative to the plane.

6. The sports implement of claim 3, wherein the plane is parallel to at least one of the first or the second contact surfaces.

7. The sports implement of claim 1, wherein the main body portion, the handle portion, and the grip member have a combined length of less than 18".

8. The sports implement of claim 1, wherein the grip body portion includes at least one finger positioning member extending therealong.

9. The sports implement of claim 1, wherein the main body portion defines a main body length and the handle portion and the grip member define a grip length, the main body length and the grip length combining to define an overall length, wherein a ratio of the grip length to the main body length is between approximately 1:3 and approximately 3:5.

10. The sports implement of claim 1, wherein the main body portion defines a main body length and the handle portion and the grip member define a grip length, the main body length and the grip length combining to define an overall length, wherein a ratio of the grip length to the overall length is between approximately 1:4 and approximately 2:5.

11. A sports implement comprising:

a main body portion including a first side having a first contact surface, a second side having a second contact surface, a sidewall extending between the first and the second contact surfaces, an upper end, and a lower end, the main body portion being bisected by a plane such that the first contact surface and the second contact surface each define a first segment, and a second segment;

a handle portion extending from the lower end of the main body portion, the handle portion defining a handle central axis extending therethrough; and a grip member including a grip body portion being operably coupled with the handle portion, a grip end portion, and a transition region having a first side and a second side extending between the grip body portion and the grip end portion, the first side of the transition region facing the first segment of the main body portion and defining a dorsal cantle region and the second side of the transition region facing the second segment of the main body portion and defining a ventral cantle region; wherein the grip end portion defines a grip central axis extending therethrough, wherein the handle central axis is offset from and parallel to the grip central axis.

12. The sports implement of claim 11, wherein the dorsal cantle region has a dorsal cantle radius of curvature and the ventral cantle region has a ventral cantle radius of curvature, wherein the ventral cantle radius of curvature is greater than the dorsal cantle radius of curvature.

13. The sports implement of claim 12, wherein the grip end portion defines a grip end plane, the grip end plane being non-perpendicular to the handle central axis.

14. The sports implement of claim 11, wherein the grip body portion has an elongated length having a substantially constant cross-sectional shape.

15. The sports implement of claim 14, wherein the cross-sectional shape includes a first planar surface, a second planar surface, a first curvilinear surface, and a second curvilinear surface, each of the first and the second curvilinear surfaces being positioned between the first and the second planar surfaces.

16. The sports implement of claim 11, wherein the main body portion, the handle portion, and the grip member have a combined length of less than 18".

17. The sports implement of claim 11, wherein the grip body portion includes at least one finger positioning member extending therealong.

18. A sports implement comprising:

a main body portion having a first contact surface being generally planar or having a slight curvature, a second contact surface being generally planar or having a slight curvature, and an outer bezel positioned about a perimeter of each of the first and the second contact surfaces to define a sidewall, the sidewall being bisected by a sagittal plane;

a handle portion extending from the main body portion, the handle portion defining a handle central axis extending therethrough; and a grip member including a grip body portion being operably coupled with the handle portion, a grip end portion, and a transition region having a first side and a second side extending between the grip body portion and the grip end portion, the first side of the transition region defining a dorsal cantle region and the second side defining a ventral cantle region;

wherein at least one of the dorsal cantle region or the ventral cantle region is positioned asymmetrically relative to the sagittal plane; wherein the grip end portion defines a grip central axis extending therethrough, wherein the handle central axis is offset from and parallel to the grip central axis.

* * * * *